US011229997B2

(12) United States Patent
Hirano et al.

(10) Patent No.: US 11,229,997 B2
(45) Date of Patent: Jan. 25, 2022

(54) WORKING MACHINE

(71) Applicant: HITACHI KOKI CO., LTD., Tokyo (JP)

(72) Inventors: Shota Hirano, Ibaraki (JP); Hiroyuki Hanawa, Ibaraki (JP); Keita Saitou, Ibaraki (JP); Naoki Sato, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 129 days.

(21) Appl. No.: 15/740,293

(22) PCT Filed: Jun. 2, 2016

(86) PCT No.: PCT/JP2016/066414
§ 371 (c)(1),
(2) Date: Dec. 27, 2017

(87) PCT Pub. No.: WO2017/002518
PCT Pub. Date: Jan. 5, 2017

(65) Prior Publication Data

US 2018/0193996 A1 Jul. 12, 2018

(30) Foreign Application Priority Data

Jun. 30, 2015 (JP) ..... JP2015-131468

(51) Int. Cl.
*B25F 5/02* (2006.01)
*B25G 1/06* (2006.01)
(Continued)

(52) U.S. Cl.
CPC ..... *B25F 5/026* (2013.01); *B25F 5/02* (2013.01); *B25G 1/06* (2013.01); *B25G 3/00* (2013.01); *B25G 3/04* (2013.01)

(58) Field of Classification Search
CPC ..... B25F 5/026; B25D 17/04; B25G 1/06
(Continued)

(56) References Cited

U.S. PATENT DOCUMENTS 4,145,848 A * 3/1979 Hutchins ..... B24B 55/102 451/359
4,729,195 A * 3/1988 Berger ..... B24B 55/10 451/357

(Continued)

FOREIGN PATENT DOCUMENTS

CN 200957554 Y 10/2007
CN 104044124 A 9/2014

(Continued)

OTHER PUBLICATIONS

Lorenz Prem, "DeWalt DCD940KZ Cordless Drill Review", Oct. 31, 2012; https://www.hingmy.com/site/article.php?DeWalt-DCD940KX-Review, 4 pages.*

(Continued)

*Primary Examiner* — Gloria R Weeks
(74) *Attorney, Agent, or Firm* — McDermott Will & Emery LLP

(57) ABSTRACT

In order to provide a working machine capable of suppressing an increase in size, a working machine that rotates a working tool with motive power of a motor includes a transmission mechanism that transmits a rotational force of the motor to the working tool, a front case in which the transmission mechanism is disposed, a holding tool that is attached to the front case so as to protrude from an outer surface of the case and is gripped by a worker, and an attaching hole which is provided in the front case and to which the holding tool is attached, and the attaching hole penetrates the front case in plan view intersecting with an axis that is a rotation center of the working tool.

23 Claims, 15 Drawing Sheets

(51) Int. Cl.
*B25G 3/00* (2006.01)
*B25G 3/04* (2006.01)

(58) Field of Classification Search
USPC ..... 173/170; 16/426
See application file for complete search history.

(56) References Cited

U.S. PATENT DOCUMENTS 5,690,451 A * 11/1997 Thurler ..... B23B 49/006 408/113
5,725,422 A * 3/1998 Leweck ..... B24B 23/005 16/426
5,775,982 A * 7/1998 Paterno ..... A47L 13/286 15/97.1
6,220,367 B1 * 4/2001 Masterson ..... B25F 5/006 173/162.2
6,266,850 B1 * 7/2001 Williams ..... B25F 5/026 144/136.95
6,725,491 B2 4/2004 Hung
6,810,547 B2 * 11/2004 Hung ..... A47L 11/4075 15/144.1
6,938,706 B2 * 9/2005 Ng ..... B25F 5/02 173/170
7,530,885 B2 * 5/2009 Sun ..... B24B 23/026 451/344
7,619,387 B2 * 11/2009 Amend ..... B25F 5/02 173/170
7,676,890 B2 * 3/2010 Zhang ..... B25F 5/006 16/431
7,886,838 B2 * 2/2011 Hahn ..... B25D 17/043 16/110.1
8,082,634 B2 * 12/2011 Frank ..... B25F 5/006 16/436
8,100,745 B2 * 1/2012 Zhang ..... B24B 41/007 451/357
8,413,743 B2 * 4/2013 Nagasaka ..... B25F 5/02 173/162.1
8,424,615 B2 * 4/2013 Baumann ..... B25F 5/021 173/170
8,813,868 B2 * 8/2014 Limberg ..... B25G 1/10 173/170
8,914,947 B2 * 12/2014 Weiss ..... B25D 17/043 16/426
9,868,201 B2 * 1/2018 Kamiya ..... B25F 5/008
9,914,205 B2 * 3/2018 Chen ..... B25F 5/026
9,956,659 B2 * 5/2018 Takeuchi ..... B23Q 11/0071
10,478,943 B2 * 11/2019 Nakamura ..... B24B 55/052
2004/0084194 A1 * 5/2004 Fuchs ..... B25F 5/02 173/170
2006/0219419 A1 * 10/2006 Sugiyama ..... B25F 5/026 173/162.2
2006/0228936 A1 * 10/2006 Chen ..... H01M 50/20 439/500
2010/0129701 A1 5/2010 Murayama et al.
2012/0160531 A1 * 6/2012 Martin ..... B25F 5/026 173/46
2014/0008090 A1 * 1/2014 Kokinelis ..... B25F 5/02 173/170
2014/0251650 A1 9/2014 Kondo

FOREIGN PATENT DOCUMENTS

JP S42-004960 Y1 3/1967
JP S62-218082 A 9/1987
JP 2010-129188 A 6/2010
JP 2012-096299 A 5/2012

OTHER PUBLICATIONS

Stuart, "Upgrade Path From DeWalt 18V Cordless Tool?", Jun. 26, 2014; https://toolguyd.com/dewalt-18v-cordless-tools-upgrade/, 29 pages.*
Search Report issued in corresponding International Patent Application No. PCT/JP2016/066414, dated Aug. 23, 2016.
Chinese Office Action issued in corresponding Chinese Patent Application No. 201680038406.6, dated Jun. 24, 2020, with Engish translation.

* cited by examiner (A)

(B)

(A)

(B)

(A)

(B)

(A)

(B)

WORKING MACHINE

CROSS REFERENCE

This application is the U.S. National Phase under 35 U.S.C. § 371 of International Application No. PCT/JP2016/066414, filed on Jun. 2, 2016, which claims the benefit of Japanese Application No. 2015-131468, filed on Jun. 30, 2015, the entire contents of each are hereby incorporated by reference.

TECHNICAL FIELD

The present invention relates to a working machine that rotates a working tool by motive power of a motor.

BACKGROUND ART

Conventionally, working machines that rotate a working tool by motive power of a motor have been known, and an example of the working machines is described in Patent Document 1. The working machine described in Patent Document 1 includes a main body and a handle serving as a holding tool attached to the main body. The main body includes a housing that houses a motor and a grip continuous with the housing.

Further, the working machine described in Patent Document 1 includes a holder for attaching and detaching the handle to and from the main body. The holder has a ring shape with a cutout portion, and the handle is fixed to the holder with a bolt and a nut. The ring-shaped holder is attached to an outer peripheral surface of the housing. A through hole is provided in the holder, and a shaft portion of the bolt is disposed in the through hole. The handle has a cylindrical shape, and a nut is provided in the handle. In the working machine described in Patent Document 1, the handle can be attached to and detached from the main body by rotating the bolt.

RELATED ART DOCUMENTS

Patent Documents

Patent Document 1: Japanese Patent Application Laid-Open Publication No. 2012-96299

SUMMARY OF THE INVENTION

Problem to be Solved by the Invention

However, the working machine described in Patent Document 1 uses a holder dedicated for attaching the holding tool to the main body, and it causes a problem of an increase in size of the working machine. In addition, since the holder is used, attachment of the holding tool is troublesome.

An object of the present invention is to provide a working machine capable of suppressing an increase in size. Further, another object of the present invention is to provide a working machine that enables easy attachment of a holding tool.

Means for Solving the Problems

A working machine according to an embodiment is a working machine that rotates a working tool by motive power of a motor, and the working machine includes: a transmission mechanism that transmits a rotational force of the motor to the working tool; a case that supports the transmission mechanism; a holding tool that is attached to the case so as to protrude from an outer surface of the case and is gripped by a worker; and an attaching hole which is provided in the case and to which the holding tool is attached, in which the attaching hole penetrates the case in plan view intersecting with an axis that is a rotation center of the working tool.

A working machine according to another embodiment is a working machine that rotates a working tool by motive power of a motor, and the working machine includes: a transmission mechanism that transmits the motive power of the motor to the working tool; a case in which the transmission mechanism is disposed; a holding tool that is attached to the case so as to protrude from an outer surface of the case and is gripped by a worker; an attaching hole which is provided in the case and to which the holding tool is attached; and an attaching surface that is provided on the case and is formed outside the attaching hole, in which the attaching surface is inclined with respect to a center line of the attaching hole.

A working machine according to another embodiment is a working machine that rotates a working tool by motive power of a motor, and the working machine includes: a transmission mechanism that transmits the motive power of the motor to the working tool; a case in which the transmission mechanism is disposed; a holding tool that is attached to the case so as to protrude from an outer surface of the case and is gripped by a worker; and an attaching hole through which the holding tool is attached to the case, in which the holding tool is disposed across an inside to an outside of the attaching hole, an intermediate member interposed between the holding tool and the case is provided, and the intermediate member supports the holding tool in a radial direction about an axis serving as a rotation center of the working tool in plan view intersecting with the axis.

A working machine according to another embodiment is a working machine that rotates a working tool by motive power of a motor, and the working machine includes: a transmission mechanism that transmits the motive power of the motor to the working tool; a case in which the transmission mechanism is disposed; a grip that protrudes from the case in a direction intersecting with an axis serving as a rotation center of the working tool; and a holding tool which is provided to the grip and is gripped by a worker.

Effects of the Invention

In the present invention, a holding tool is disposed in an attaching hole of a case, so that the holding tool is fixed to a main body. Therefore, an increase in size of the working machine can be suppressed. Further, the holding tool can be easily attached to the working machine.

DETAILED DESCRIPTION OF PREFERRED EMBODIMENTS

Hereinafter, embodiments of a working machine according to the present invention will be described in detail with reference to the drawings.

Figure 1:
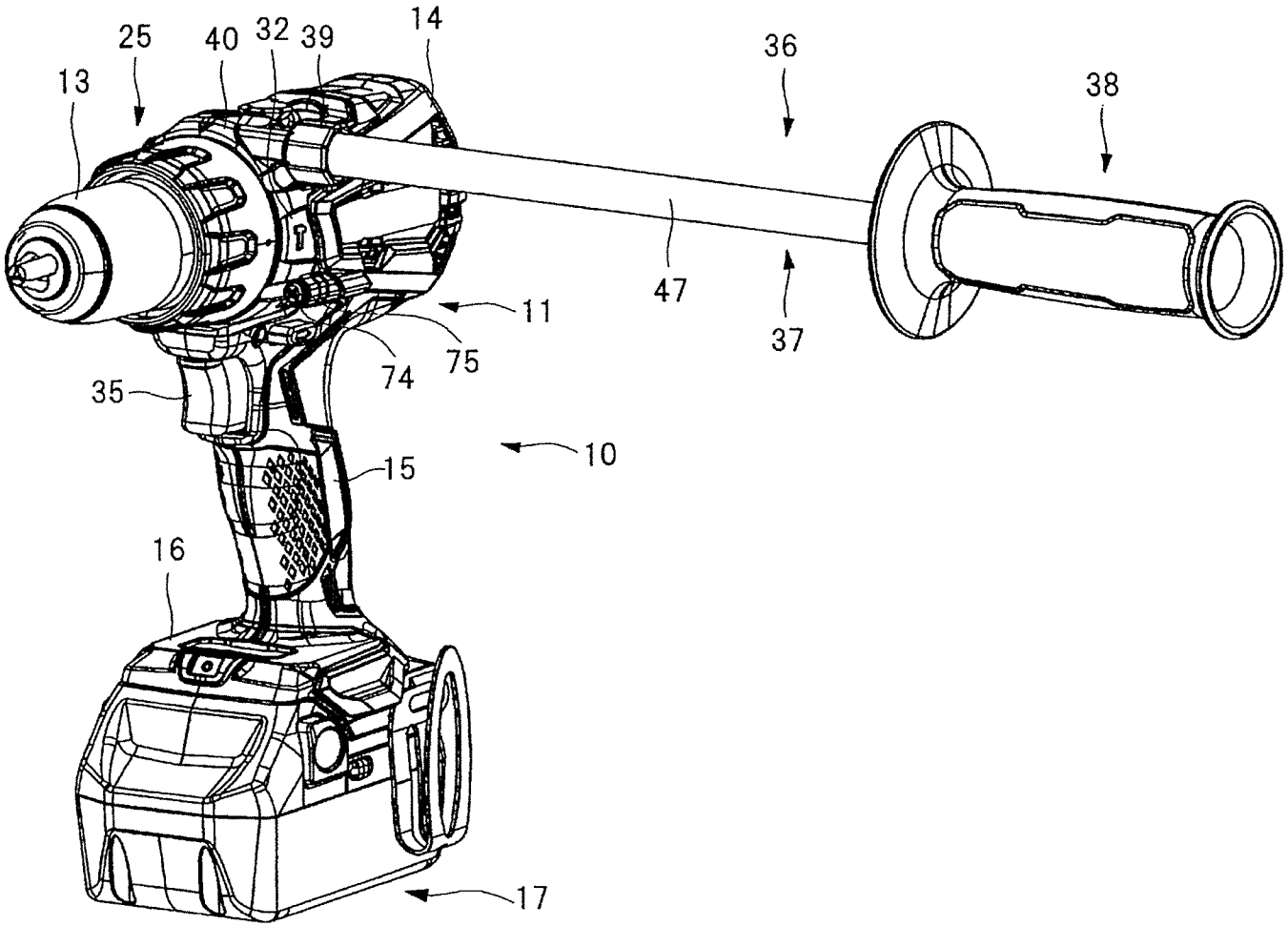
FIG. 1 is a perspective view showing a state where a working machine of the present invention is assembled.
Figure 2:
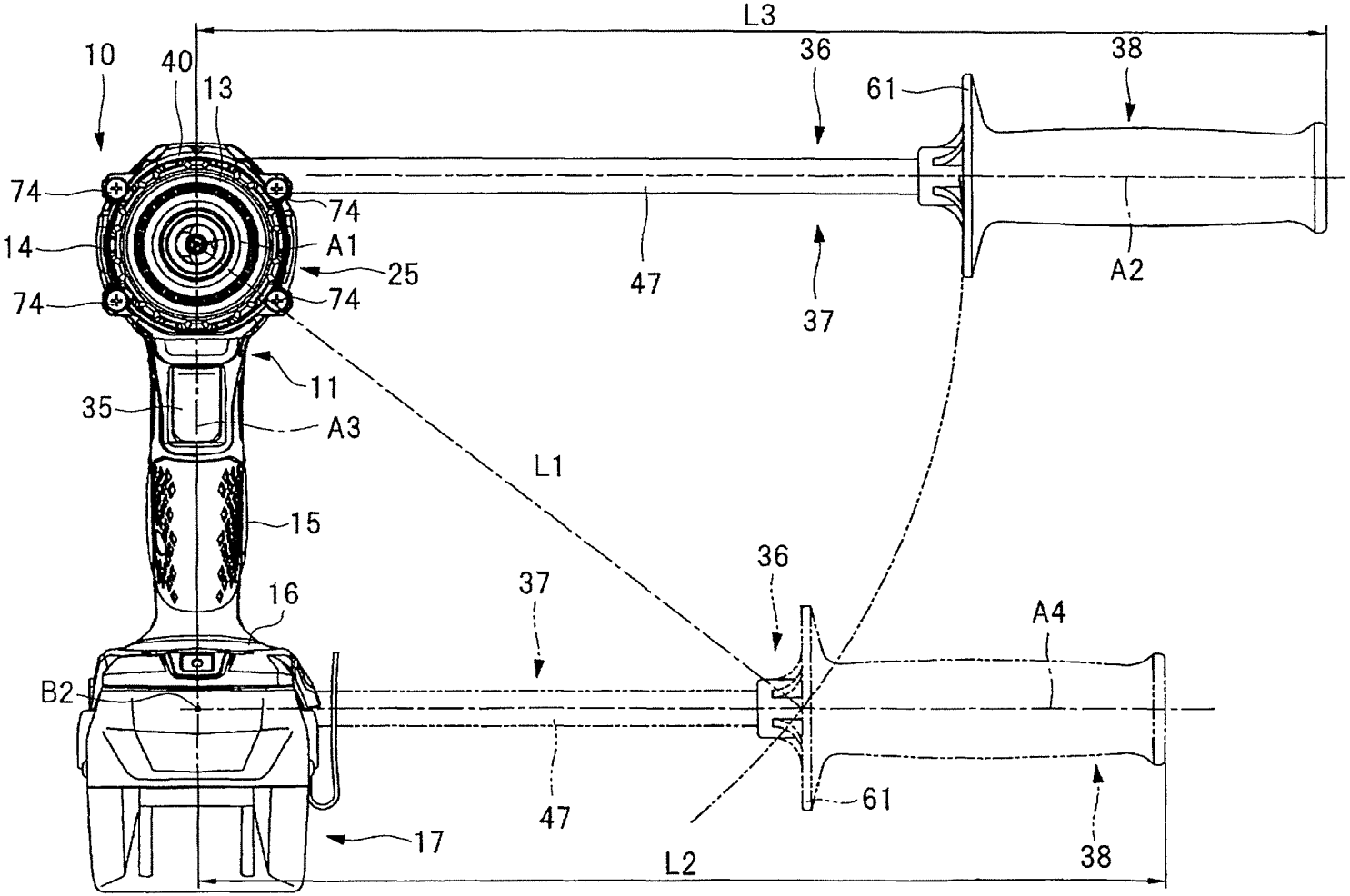
FIG. 2 is a front view of the working machine of FIG. 1.
Figure 3:
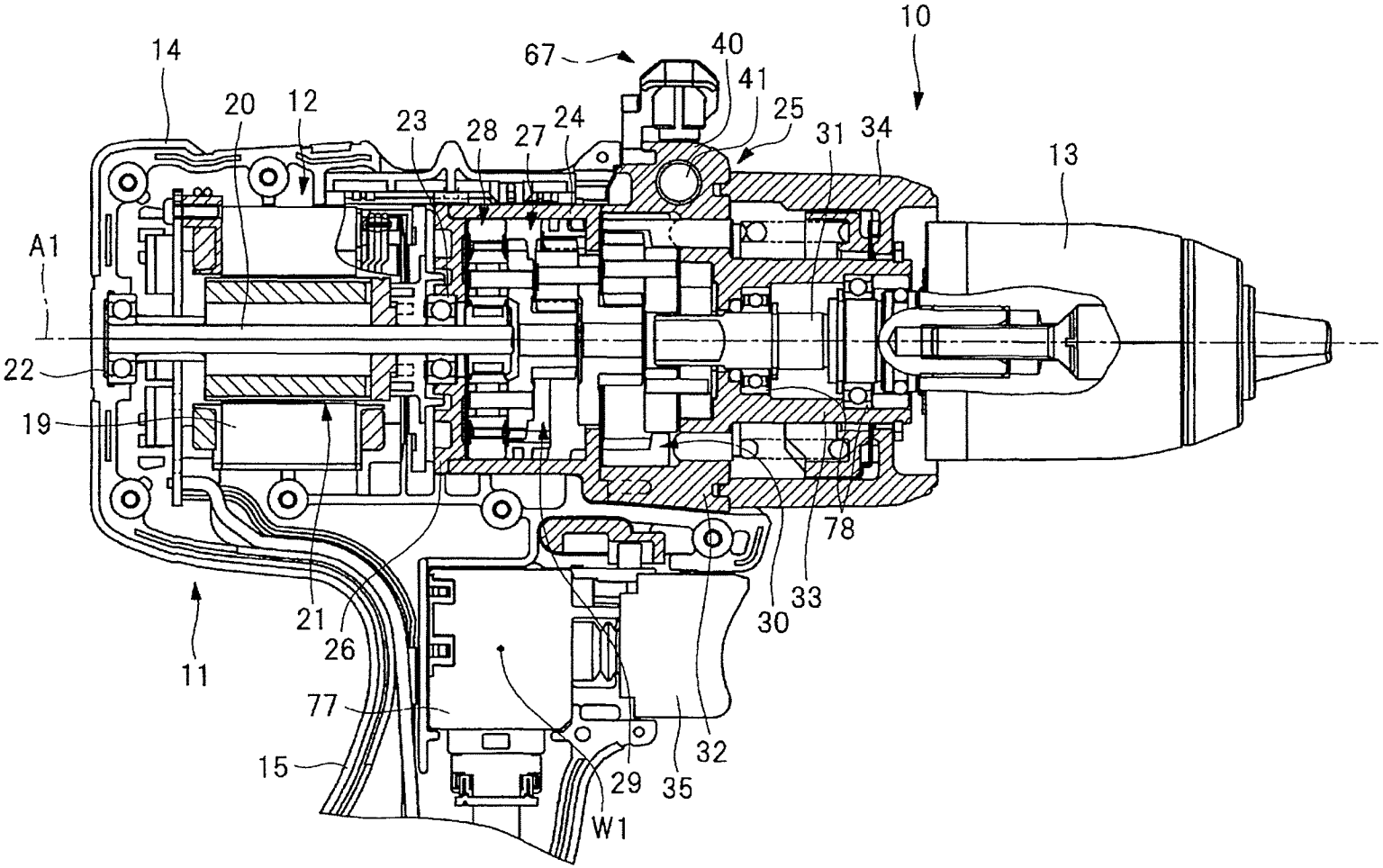
FIG. 3 is a side sectional view showing an internal structure of the working machine of FIG. 1.

A working machine 10 shown in FIGS. 1 to 3 includes a main body 11, an electric motor 12 provided in the main body 11, and a chuck 13 which is disposed outside the main body 11 and to which a torque of the electric motor 12 is transmitted. A driver bit or a drill bit as a working tool can be attached to and detached from the chuck 13. The main body 11 includes a housing 14 and a grip 15 continuous with the housing 14. The grip 15 is provided for a worker to grasp the working machine 10. A mounting portion 16 is provided at an end of the grip 15 on an opposite side of the housing 14, and a battery pack 17 can be attached to or detached from the mounting portion 16.

Figure 4:
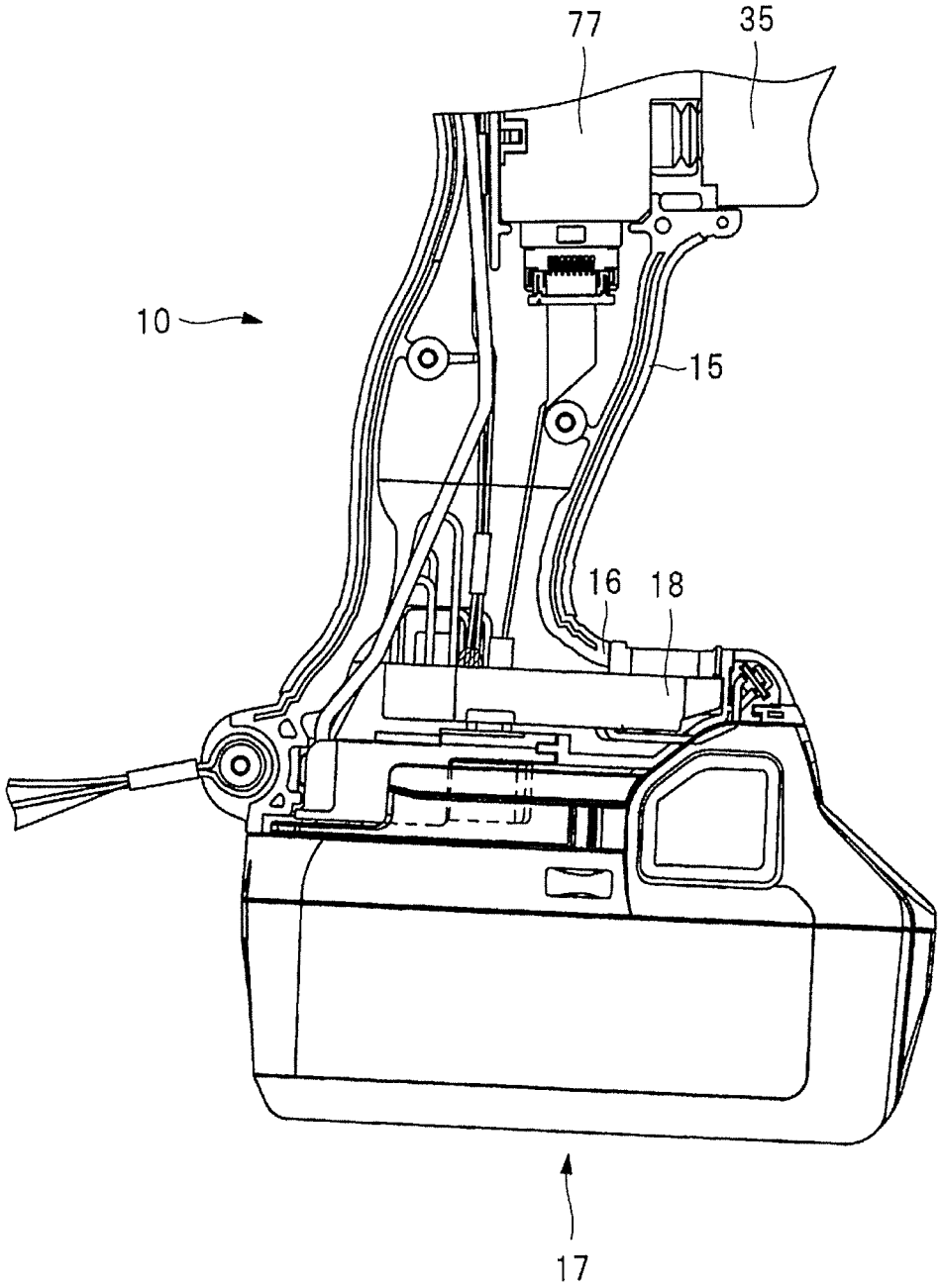
FIG. 4 is a side sectional view showing a grip of the working machine of FIG. 1.

The battery pack 17 is a case in which battery cells are housed. As the battery cell, a lithium ion battery, a nickel hydrogen battery, a lithium ion polymer battery, a nickel cadmium battery, or the like can be used. As shown in FIG. 4, a control unit 18 is provided in the mounting portion 16, and the control unit 18 controls the magnitude of a voltage and a current to be applied to the electric motor 12 from the battery pack 17. By this control, a rotating direction, the number of rotations, and the torque of a rotary shaft 20 of the electric motor 12 are controlled.

The electric motor 12 is a power device that converts electric power into motive power. As shown in FIG. 3, the electric motor 12 includes a stator 19 fixed to the housing 14 and a rotor 21 rotatably provided in the housing 14. The stator 19 includes a coil to which a voltage is applied, and the rotor 21 includes a permanent magnet. The rotor 21 is fixed to the rotary shaft 20, and two bearings 22 and 23 that rotatably support the rotary shaft 20 are provided in the housing 14. The rotation center of the rotary shaft 20 is an axis A1.

A rear case 24 is provided in the housing 14, and a front case 25 exposed outside the housing 14 is provided. The rear case 24 is disposed between the electric motor 12 and the front case 25 in a direction along the axis A1. A partition wall 26 is provided in the housing 14 and is disposed between the electric motor 12 and the rear case 24 in the direction along the axis A1. The partition wall 26 supports the bearing 23.

The front case 25 and the rear case 24 are not rotated with respect to the housing 14. The front case 25 is fixed to the housing 14 with screw members 74. Both the front case 25 and the rear case 24 have a cylindrical shape. The rear case 24 and the front case 25 are made of metal such as aluminum, and the rigidity of each of the rear case 24 and the front case 25 is higher than the rigidity of the housing 14. A gearbox 27 is disposed across an inside of the front case 25 and an inside of the rear case 24. Note that the rear case 24 and the front case 25 may be formed of the same resin as the housing 14 as long as the rigidity can be secured.

The gearbox 27 includes a first planetary gear mechanism 28, a second planetary gear mechanism 29, and a third planetary gear mechanism 30. The first planetary gear mechanism 28 and the second planetary gear mechanism 29 are disposed in the rear case 24. The third planetary gear mechanism 30 is disposed in the front case 25. The first planetary gear mechanism 28, the second planetary gear mechanism 29, and the third planetary gear mechanism 30 include an input element, a reaction element, and an output element, respectively. The rotary shaft 20 is coupled to the input element of the first planetary gear mechanism 28. The output element of the third planetary gear mechanism 30 is coupled to a spindle 31, and the chuck 13 is attached to the spindle 31.

Two bearings 78 that rotatably support the spindle 31 are provided in the front case 25. Namely, the main body 11 supports the spindle 31 and the chuck 13 via the front case 25 and the bearings 78. The gearbox 27 is a transmission mechanism that transmits a rotational force of the electric motor 12 to the spindle 31, and the gearbox 27 changes a ratio between the number of rotations of the rotary shaft 20 and the number of rotations of the spindle 31.

The motive power transmitted from the electric motor 12 to the first planetary gear mechanism 28 is transmitted to the spindle 31 through the second planetary gear mechanism 29 and the third planetary gear mechanism 30. When the power is transmitted from the second planetary gear mechanism 29 to the spindle 31 through the third planetary gear mechanism 30, the reaction element of the third planetary gear mechanism 30, for example, a ring gear bears a reaction torque thereof.

Figure 7:
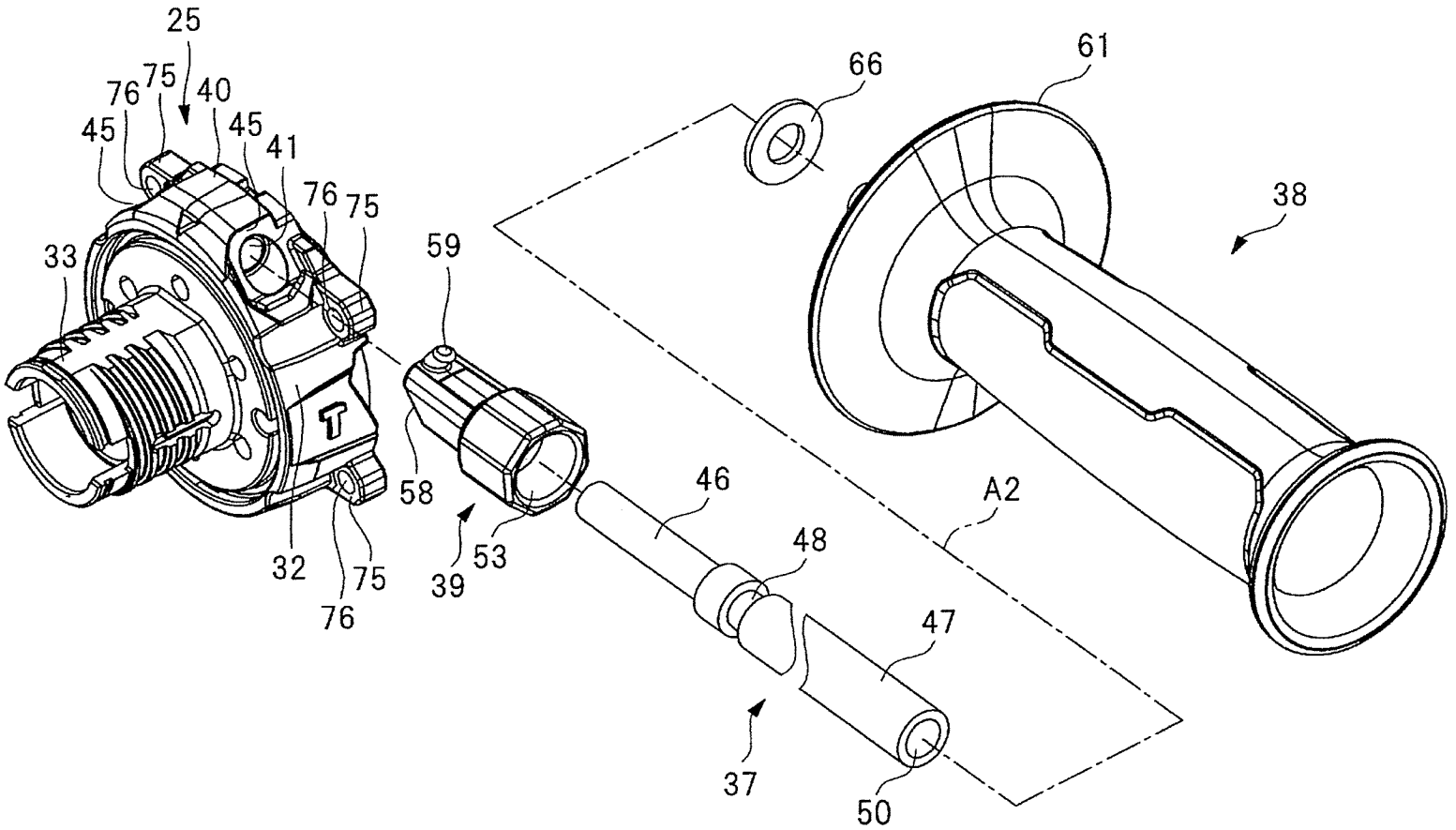
FIG. 7 is a perspective view showing the holding tool in a disassembled state.

The front case 25 includes a first cylindrical portion 32 and a second cylindrical portion 33. As shown in FIG. 7, a plurality of boss portions 75 protruding from an outer peripheral surface of the first cylindrical portion 32 are provided, and holes 76 are respectively provided in the plurality of boss portions 75. The screw members 74 are respectively inserted into the plurality of holes 76. An outer diameter of the first cylindrical portion 32 is larger than an outer diameter of the second cylindrical portion 33. The third planetary gear mechanism 30 is disposed in the first cylindrical portion 32, and the spindle 31 is disposed across an inside of the first cylindrical portion 32 and an inside of the second cylindrical portion 33. A clutch dial 34 is attached to the front case 25. The clutch dial 34 is rotatable with respect to the front case 25.

The reaction element of the third planetary gear mechanism 30 is rotatably provided with respect to the front case 25, and it is also possible to fix the reaction element to the front case 25. Namely, the front case 25 supports the third planetary gear mechanism 30 located most downstream in a power transmission path from the electric motor 12 to the spindle 31. When the clutch dial 34 is operated, the rotation speed of the reaction element of the third planetary gear mechanism 30 is adjusted, and the torque output from the spindle 31 can be adjusted.

Next, an example of use of the working machine 10 will be described. A selector switch for switching the rotating direction of the rotary shaft 20 of the electric motor 12 between forward rotation and reverse rotation is provided in the main body 11. The selector switch is operated by the worker, and an operation signal of the selector switch is input to the control unit 18. The control unit 18 changes the direction of the current to be supplied to the coil of the electric motor 12, thereby switching the rotating direction of the rotary shaft 20.

In addition, a trigger 35 is provided on the grip 15, and a trigger switch 77 is provided in the grip 15. The trigger switch 77 is disposed between the housing 14 and the mounting portion 16 in a direction of a straight line A3. When the worker operates the trigger 35, the trigger switch 77 is turned on or off, and a signal output from the trigger switch 77 is input to the control unit 18. The control unit 18 outputs a control signal for connecting or disconnecting a path for supplying a current to the stator 19 of the electric motor 12.

A moment about the axis A1 is generated with respect to the housing 14 during an operation to rotate the working tool by driving the electric motor 12. The working machine 10 includes a holding tool 36 shown in FIGS. 1, 2, and 5 to 7. The holding tool 36 is provided for suppressing the main body 11 from vibrating in a direction of rotation about the axis A1. The vibration of the main body 11 indicates rotation about the axis A1. The holding tool 36 includes a joint 37 and a handle 38. Further, the working machine 10 includes a mount member 39. The mount member 39 supports the holding tool 36 attached to the main body 11. A first end portion of the joint 37 is attached to the front case 25, the mount member 39 supports the joint 37, and the handle 38 is attached to a second end portion of the joint 37.

In FIG. 2 in which the working machine 10 is viewed from the front, a fixing portion 40 is provided at a position of the front case 25 on a side opposite to a position of the grip 15 in a circumferential direction of the front case 25. The position where the fixing portion 40 is provided is located on an opposite side of the position where the grip 15 is disposed across the axis A1. The fixing portion 40 has an attaching hole 41 penetrating in a plane direction perpendicular to the axis A1. The attaching hole 41 is disposed on an outer side relative to the third planetary gear mechanism 30 in a radial direction about the axis A1. An internal thread 42 is formed in an inner surface of the attaching hole 41. The fixing portion 40 has recessed portions 43 and 44 connected to the attaching hole 41, on both sides of the attaching hole 41 in a direction of a center line A2.

Figure 5:
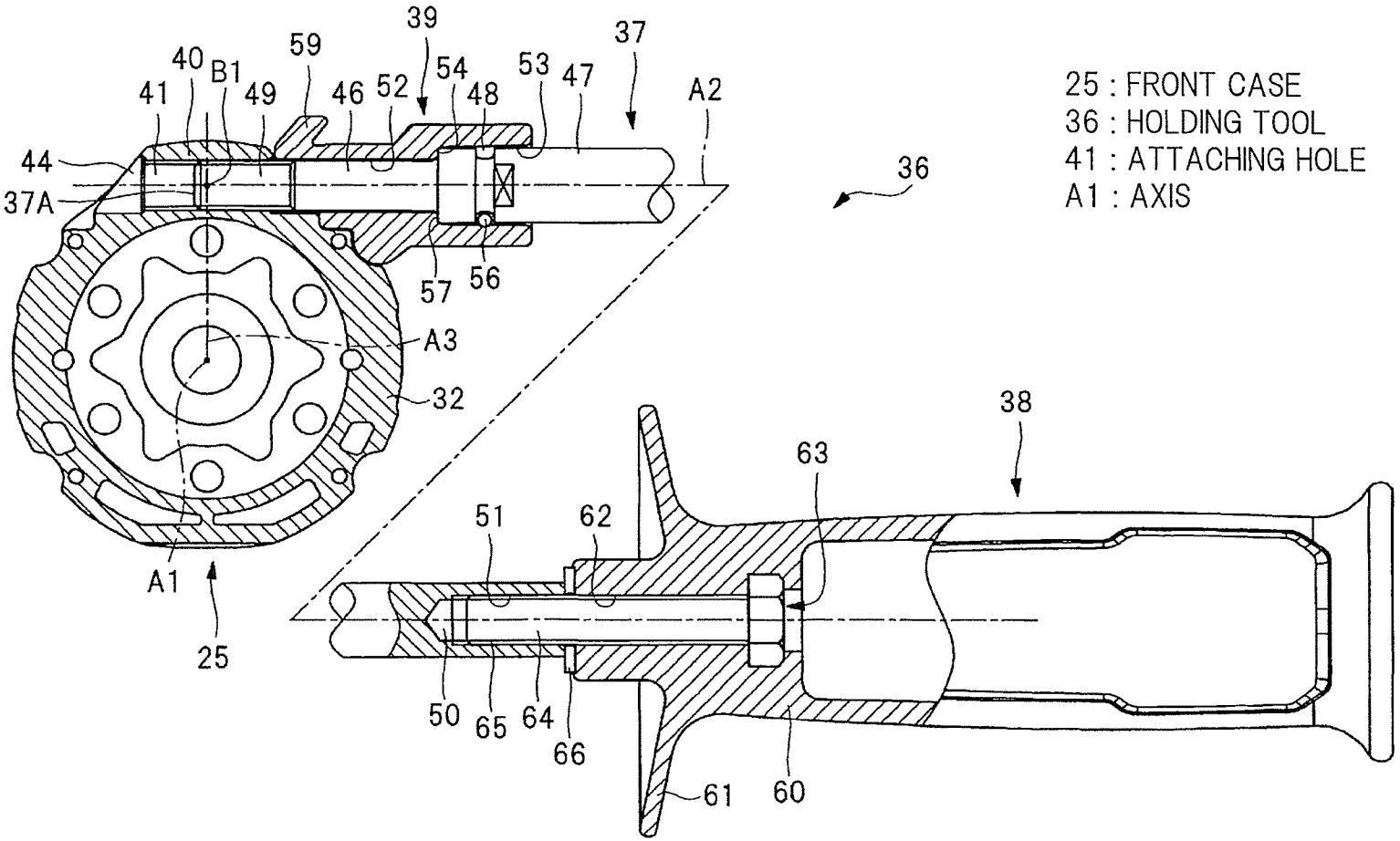
FIG. 5 is a front sectional view showing an example of attaching a holding tool to the working machine of FIG. 1.
Figure 6:
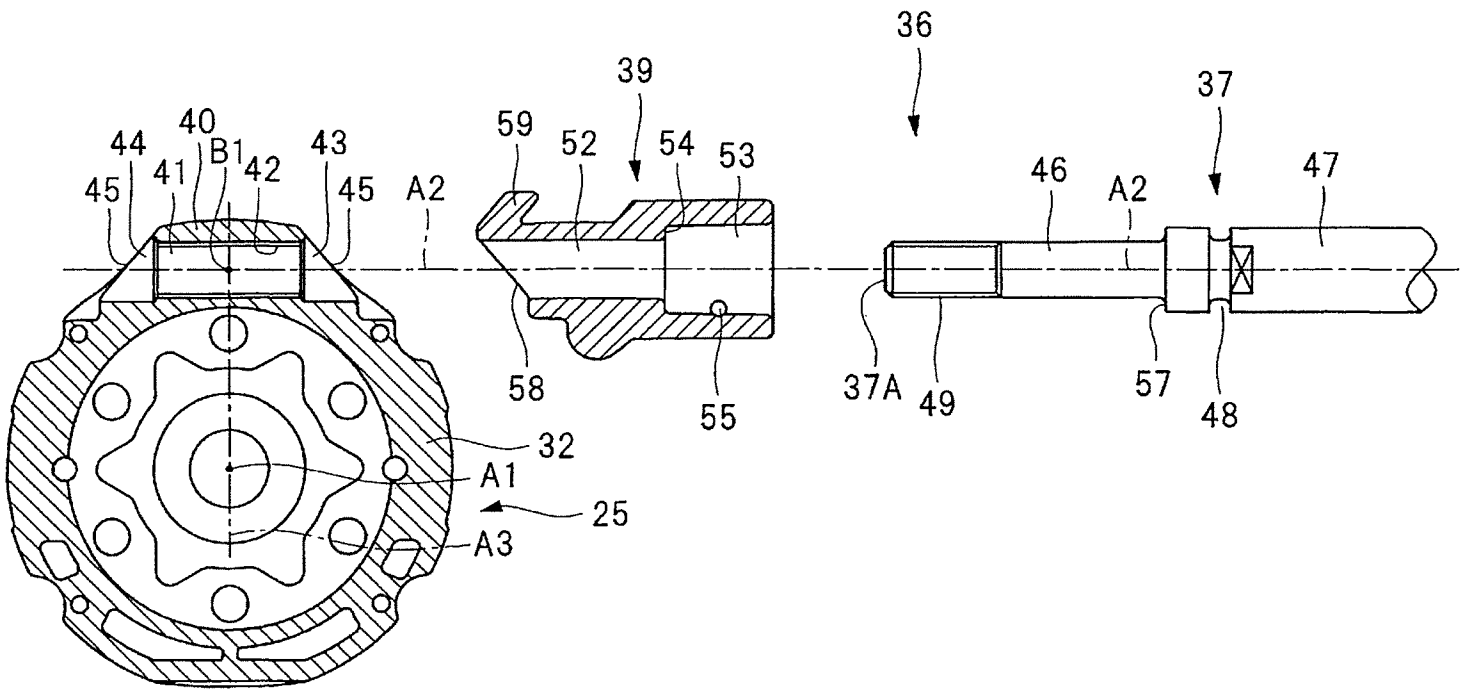
FIG. 6 is a front sectional view showing the holding tool in a disassembled state.

In addition, as shown in FIGS. 6 and 7, the fixing portion 40 is provided with contact surfaces 45 that respectively surround the two recessed portions 43 and 44. The two contact surfaces 45 are flat and inclined with respect to a straight line A3 that passes through the axis A1. The straight line A3 passes through the center of the grip 15 and the axis A1 in FIG. 2 that is a plan view of the working machine 10. Namely, the grip 15 protrudes in a direction of the straight line A3 from the housing 14 in the front view of the working machine 10. Further, as shown in FIGS. 5 and 6, an intersection B1 of the center line A2 and the straight line A3 corresponds to the center of the attaching hole 41 in the direction of the center line A2. The two contact surfaces 45 are inclined in a direction in which an interval in the direction of the center line A2 becomes narrower as the two contact surfaces 45 are spaced away from the straight line A1. Namely, the two contact surfaces 45 are inclined in opposite directions with respect to the straight line A3.

The joint 37 is a shaft connecting the handle 38 and the front case 25, and is made of a metal material, for example, a steel material. The joint 37 is made up of a first shaft portion 46 and a second shaft portion 47 disposed in series in the direction of the center line A2, and an outer diameter of the first shaft portion 46 is smaller than an outer diameter of the second shaft portion 47. An annular groove 48 is provided in an outer periphery of the second shaft portion 47. The first shaft portion 46 is inserted into the attaching hole 41, and an external thread 49 is formed in an outer peripheral surface of the first shaft portion 46. The first shaft portion 46 is screwed into the attaching hole 41, so that the joint 37 is fixed to the front case 25. The joint 37 is disposed across an inside to an outside of the attaching hole 41. A range of the first shaft portion 46 having the external thread 49 formed in the direction of the center line A2 is shorter than a length of the attaching hole 41 in the direction of the center line A2.

In a state where the external thread 49 is screwed in the internal thread 42 of the attaching hole 41, a part of the first shaft portion 46 is located outside the attaching hole 41 and the recessed portion 43. In the joint 37, a fixing hole 50 is provided at an end portion on a side opposite to the first shaft portion 46. An internal thread 51 is formed in an inner peripheral surface of the fixing hole 50. The mount member 39 is integrally formed of a synthetic resin. The mount member 39 has a cylindrical shape and has a first support hole 52 and a second support hole 53. An inner diameter of the first support hole 52 is smaller than an inner diameter of the second support hole 53. The inner diameter of the first support hole 52 is constant in the direction of the center line A2 and the inner diameter of the second support hole 53 is constant in the direction of the center line A2. Namely, no internal thread is provided in inner surfaces of the first support hole 52 and the second support hole 53.

A stepped portion 54 continuous with the inner surface of the first support hole 52 and the inner surface of the second support hole 53 is provided. The stepped portion 54 is annularly formed about the center line A2 and is a flat surface perpendicular to the center line A2. Further, in a state where the first shaft portion 46 is disposed in the first support hole 52 and the second shaft portion 47 is disposed in the second support hole 53, the external thread 49 of the first shaft portion 46 is disposed outside the first support hole 52.

In addition, a hole 55 penetrating a position of the mount member 39 corresponding to the second support hole 53 in the radial direction is provided, and a retainer 56 is inserted in the hole 55. The retainer 56 is disposed in the groove 48 in the direction of the center line A2 and is engaged with the second shaft portion 47, so that the mount member 39 and the joint 37 are positioned in the direction of the center line A2. When the external thread 49 of the joint 37 is screwed into the internal thread 42 of the fixing portion 40 and tightening is completed, the holding tool 36 is positioned and fixed to the front case 25 as shown in FIG. 5. Specifically, an end surface 57 of the second shaft portion 47 is pressed against the stepped portion 54 of the mount member 39, and the mount member 39 is sandwiched between the fixing portion 40 and the second shaft portion 47. A tip end 37A of the joint 37 is located between the recessed portion 44 and the intersection B1 in the direction of the center line A2. Namely, the tip end 37A is located on a side closer to the recessed portion 44 relative to the straight line A3.

Further, as shown in FIGS. 6 and 7, a contact surface 58 that surrounds an opening end of the first support hole 52 is provided in the mount member 39. The contact surface 58 is flat and inclined in the same direction as the contact surface 45 of the fixing portion 40. When the mount member 39 is pressed against the fixing portion 40 and positioned, the mount member 39 is sandwiched between the fixing portion 40 and the joint 37 in a state where the contact surface 58 is in surface contact with the contact surface 45.

Further, a projection 59 is provided on an outer surface of the mount member 39. When the worker positions the mount member 39 to the front case 25, the worker can confirm the position of the mount member 39 in the circumferential direction of a circle centered on the center line A2 by visually checking the projection 59.

The handle 38 includes a main body 60 integrally formed of a synthetic resin and an annular flange 61 provided on the main body 60. The flange 61 protrudes outward from an outer peripheral surface of the main body 60. A shaft hole 62 is provided in the main body 60, and a shaft portion 64 of a bolt 63 is disposed in the shaft hole 62. An external thread 65 is formed in an outer peripheral surface of the shaft portion 64, and a part of the shaft portion 64 is disposed outside the main body 60. The center line A2 is common to a center line of the bolt 63, and the external thread 65 of the bolt 63 is screwed in the internal thread 51 of the joint 37.

Specifically, the handle 38 is fixed to the joint 37 by fastening the bolt 63. Note that the fixing hole 50 is filled with an adhesive to prevent loosening of the bolt 63. Further, a metal washer 66 is interposed between the joint 37 and the handle 38. The washer 66 has an annular shape, and the shaft portion 64 of the bolt 63 is inserted through the washer 66.

The holding tool 36 can impart a torque, which suppresses the rotation of the front case 25 about the axis A1, to the front case 25. The torque that can be generated by the holding tool 36 has a value corresponding to the length of the arm of the moment from the axis A1 to the handle 38. The torque that can be generated by the holding tool 36 is higher as the length of the arm of the moment is larger. For example, as shown in FIG. 2, a distance L1 from the axis A1 to the flange 61 can be grasped as the length of the arm of the moment.

The mount member 39 supports a portion of the first shaft portion 46 having no external thread 49 provided therein and a part of the second shaft portion 47 in the radial direction. Namely, the mount member 39 apparently increases a range to support the joint 37 in the direction of the center line A2. Therefore, it is possible to suppress elastic deformation of the joint 37 in the radial direction at a boundary position between the first shaft portion 46 and the second shaft portion 47.

Further, when the worker grips the handle 38 to integrally rotate the handle 38 and the joint 37, the holding tool 36 can tighten or loosen the external thread 49. Namely, the holding tool 36 can be attached to and detached from the front case 25. Therefore, the worker can attach the holding tool 36 to the front case 25 and detach the holding tool 36 from the front case 25 by rotating the handle 38 with one hand, so that the handleability and operability of the working machine 10 are improved. In addition, since the front case 25 and the joint 37 are fixed with the screw mechanism, the number of parts can be reduced.

Further, the mount member 39 is partially disposed on the outer peripheral surface of the front case 25, and there is no need to surround the outer peripheral surface of the front case 25 in the circumferential direction. Therefore, it is possible to suppress an increase in size of the working machine 10 in the radial direction about the axis A1. In addition, as compared with a configuration of a conventional working machine in which a holding tool is attached to a main body by using a ring-shaped holder, it is possible to suppress an increase in size of the working machine 10 of the present embodiment in a direction of the axis A1.

Further, the front case 25 to which the holding tool 36 is attached is an element provided to house the third planetary gear mechanism 30. Namely, it is not necessary to provide an element dedicated for fixing the holding tool 36 to the main body 11. Therefore, reduction in the number of parts of the working machine 10, reduction in weight of the working machine 10, and reduction in manufacturing cost of the working machine 10 can be realized.

In addition, in a state where the external thread 49 is loosened and the joint 37 is detached from the front case 25, the mount member 39 and the joint 37 of the holding tool 36 can be disassembled by pulling out the retainer 56 from the hole 55. Therefore, the length of the joint 37 to be used can be changed in accordance with the torque generated in the chuck 13 by preparing a plurality of types of the joint 37 having different lengths in the direction of the center line A2 and selecting the favorable joint 37. Further, when the mount member 39 is damaged, the mount member 39 can be independently replaced without replacing the front case 25 and the joint 37.

In addition, the attaching hole 41 penetrates the fixing portion 40 in the direction of the center line A2, and the recessed portions 43 and 44 are provided on both sides of the attaching hole 41. Therefore, the holding tool 36 can be attached on a right side of the front case 25 in the front view of the working machine 10 in FIG. 2. Further, the holding tool 36 can also be attached on a left side of the front case 25 in the front view of the working machine 10 in FIG. 2. Note that the holding tool 36 can be attached on the left side of the front case 25 by inserting the first shaft portion 46 into the attaching hole 41 through the recessed portion 44.

Also, the attaching hole 41 is common in both the cases where the holding tool 36 is attached on the right side of the working machine 10 and is attached on the left side of the working machine 10 in the front view. Therefore, it is not necessary to provide separate attaching holes for the cases where the holding tool 36 is attached on the right side of the working machine 10 and is attached on the left side of the working machine 10 in the front view. Accordingly, the length of the attaching hole 41 in the direction of the center line A2 can be made as short as possible.

As mentioned above, the attaching hole 41 penetrates the fixing portion 40 in the direction of the center line A2. Therefore, in a processing step of the front case 25, the attaching hole 41 can be formed by cutting the front case 25 from one direction with a drill. Accordingly, the number of steps for the processing of the front case 25 can be reduced to improve productivity, and the cost of the working machine 10 can be reduced. Further, since the attaching hole 41 penetrates the fixing portion 40 in the direction of the center line A2, the metal material constituting the front case 25 can be reduced, and the working machine 10 can be made as light as or as small as possible.

Furthermore, one of the factors to determine the fixing strength between the joint 37 and the front case 25 is a connection length between the joint 37 and the fixing portion 40 in the direction of the center line A2. Also, since the attaching hole 41 penetrates the fixing portion 40, the connection length between the joint 37 and the fixing portion 40 can be made as large as possible in the direction of the center line A2. For example, the connection length between the joint 37 and the fixing portion 40 can be set such that the tip end 37A of the joint 37 is located between the center of the attaching hole 41 in a left and right direction and the recessed portion 44 when the joint 37 is attached by moving it in the direction of the center line A2 through a first opening portion of the attaching hole 41. Here, the first opening portion is the recessed portion 43, and a second opening portion is the recessed portion 44. Further, the center of the attaching hole 41 in the left and right direction is the intersection B1 of the straight line A3 and the center line A2. Therefore, it is possible to enhance the fixing strength between the joint 37 and the front case 25.

Further, the two contact surfaces 45 provided in the fixing portion 40 are inclined with respect to the straight line A3 in the direction in which the interval in the direction of the center line A2 becomes narrower as the two contact surfaces 45 are spaced away from the straight line A1. Therefore, the height of the fixing portion 40 in the direction of the straight line A3 can be made as small as possible, and it is possible to suppress the fixing portion 40 from coming into contact with an object.

When it is assumed that inclined portions of the contact surfaces 45 of the fixing portion 40 are formed in inner surfaces of the recessed portions 43 and 44, the thickness of the first cylindrical portion 32 of the front case 25 from an inner periphery to an outer periphery is reduced in the direction of the straight line A3. As a result, when a load is applied to the first cylindrical portion 32, the first cylindrical portion 32 is easily broken. In contrast, the front case 25 of the present embodiment is provided with the contact surfaces 45 inclined outside the recessed portions 43 and 44. Namely, since the first cylindrical portion 32 is configured to have a portion with a large thickness, the first cylindrical portion 32 is less easily damaged even if a load is applied to the first cylindrical portion 32. In addition, since the contact surfaces 45 are provided in the fixing portion 40, the fixing portion 40 is less easily damaged even if the contact surface 45 hits against a wall or the like during work.

Further, the joint 37 is fixed to the front case 25 via the mount member 39. Therefore, the mount member 39 plays a role of receiving a load of the joint 37 in a direction intersecting with the center line A2. Thus, swinging of the joint 37 about the fixing portion 40 as a fulcrum can be suppressed. Furthermore, when the joint 37 is fixed to the fixing portion 40, the contact surface 45 of the fixing portion 40 and the contact surface 58 of the mount member 39 are in surface contact with each other. Namely, the contact area between the fixing portion 40 and the mount member 39 can be made as large as possible, so that the function to support the joint 37 by the mount member 39 is improved.

Further, the joint 37 is fixed to the front case 25 with the mount member 39 interposed between the front case 25 and the joint 37. Therefore, it is only necessary to match the shape and structure of the mount member 39 with the shape and structure of the front case 25. Namely, the joint 37 can be fixed to the front case 25 irrespective of the shape and structure of the front case 25.

Figure 8:
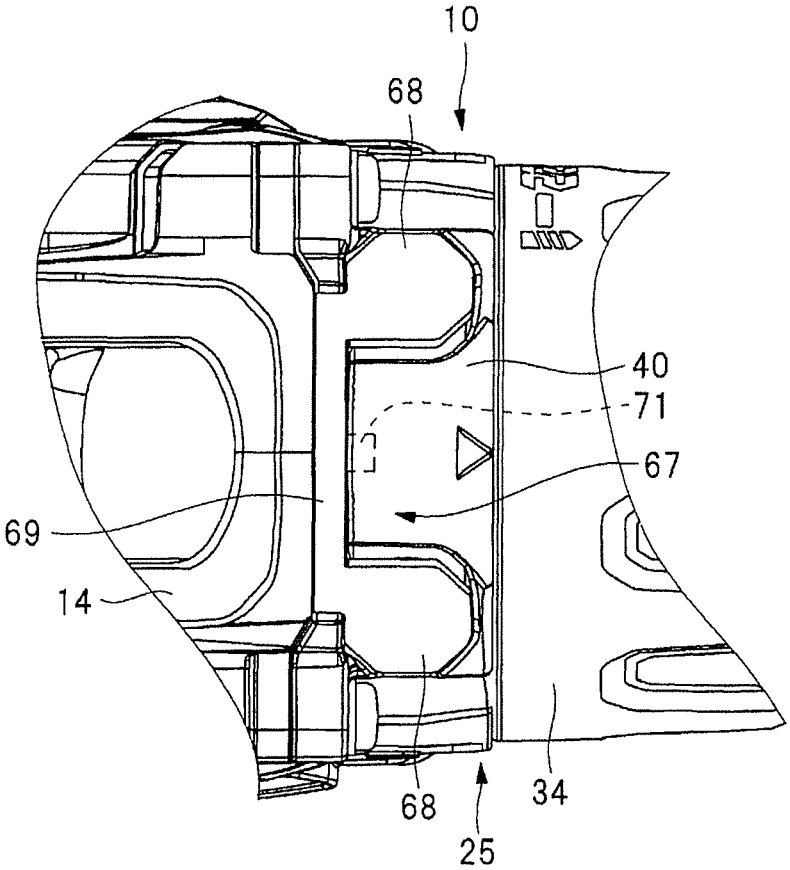
FIG. 8(A) is a plan view of a cap attached to the working machine.
FIG. 8(B) is a side view of the cap.
Figure 8:
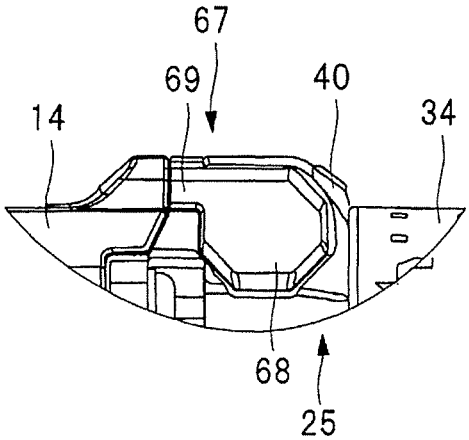
Figure 9:
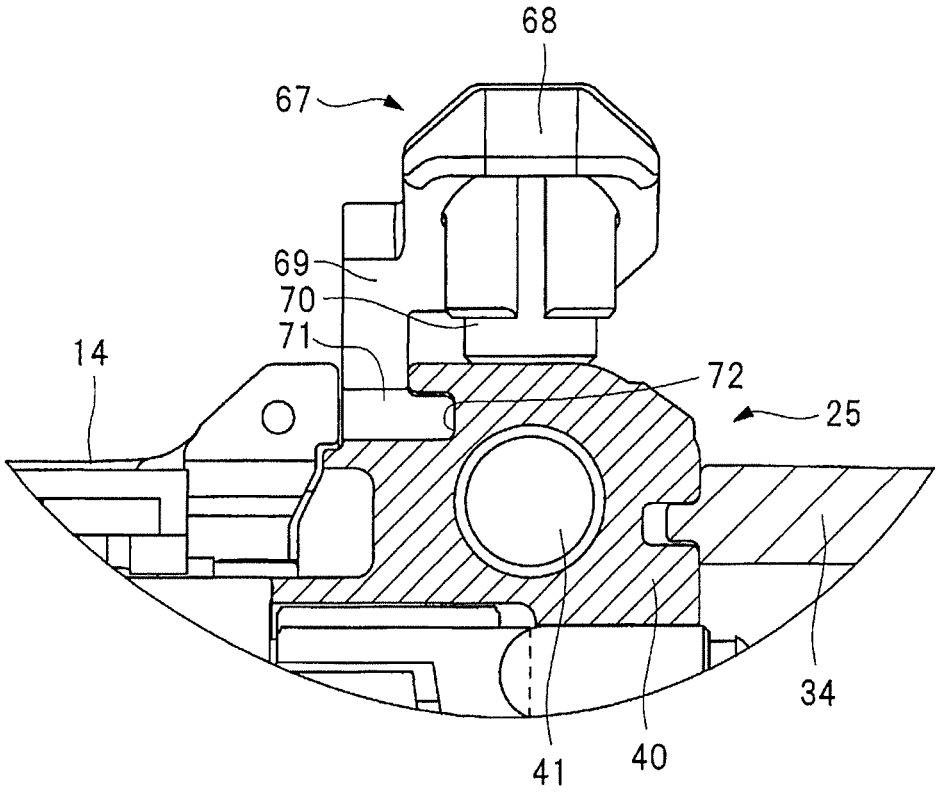
FIG. 9(A) is a side view showing a state where a plug of the cap is pulled out of an attaching hole.
FIG. 9(B) is a perspective view of the cap alone.
Figure 9:
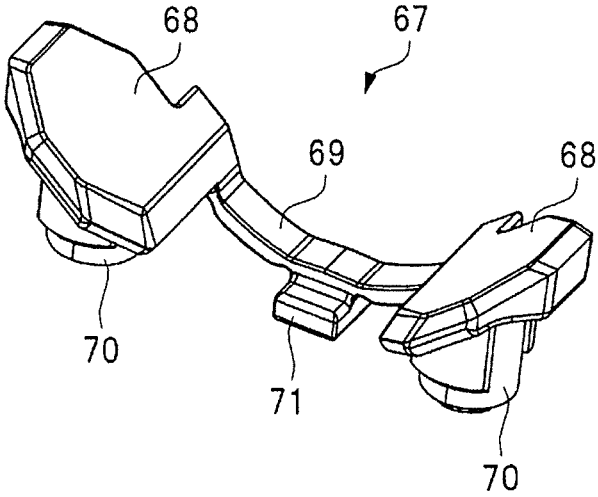
Figure 10:
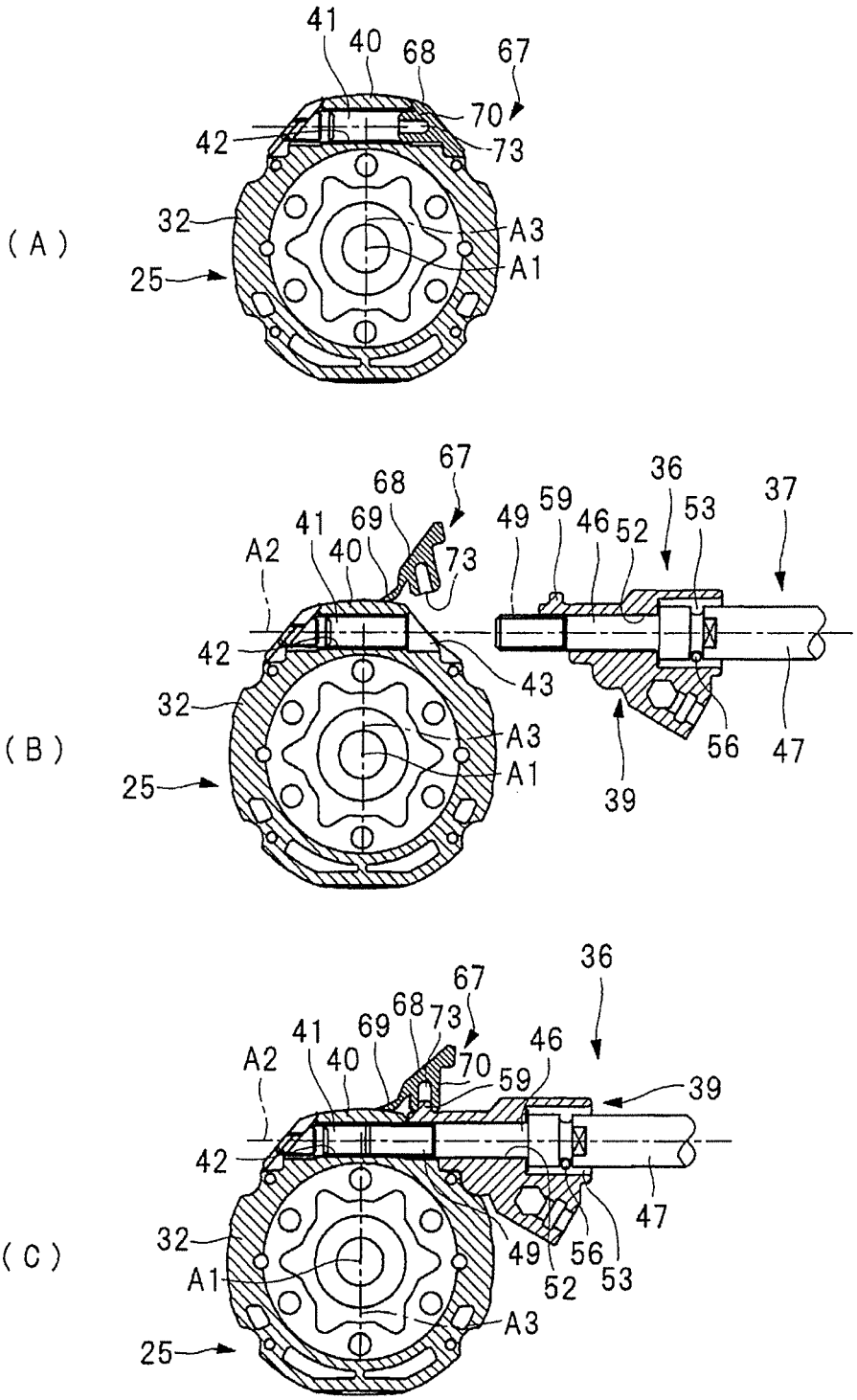
FIGS. 10(A) to 10(C) are front sectional views showing a process of detaching the cap and attaching the holding tool to a front case.

Further, the working machine 10 may be provided with a cap 67 shown in FIGS. 8 to 10. The cap 67 is a sealing element that blocks the attaching hole 41. The cap 67 is integrally formed of synthetic rubber and includes two gripping portions 68, a connecting portion 69 that connects the two gripping portions 68, plugs 70 respectively provided to the two gripping portions 68, and a base portion 71 provided in the connecting portion 69 as shown in FIG. 9. The connecting portion 69 is elastically deformable. A locking groove 72 is provided in the fixing portion 40 of the front case 25, and the base portion 71 is disposed in the locking groove 72. The base portion 71 is sandwiched between the fixing portion 40 of the front case 25 and the housing 14, and the cap 67 is attached to the front case 25. The plug 70 is provided with an insertion hole 73 as shown in FIG. 10(B).

When the holding tool 36 is not attached to the front case 25, the worker can insert the plugs 70 into the attaching hole 41 through the recessed portions 43 and 44 by gripping the gripping portions 68 with fingers to elastically deform the connecting portion 69. The cap 67 blocks the attaching hole 41 as shown in FIG. 10(A) so as to prevent entry of a foreign matter into the attaching hole 41. In other words, the cap 67 protects the internal thread 42. The foreign matter includes chips and dusts.

When attaching the holding tool 36 to the front case 25, the worker grips the gripping portions 68 with fingers and pulls out the plugs 70 from the attaching hole 41 as shown in FIG. 10(B). Next, the external thread 49 of the joint 37 is screwed into the internal thread 42 of the attaching hole 41, so that the holding tool 36 is fixed to the front case 25 as shown in FIG. 10(C). Then, the worker holds the gripping portions 68 with fingers and fits the projection 59 of the mount member 39 into the hole 73 of the plug 70. Even if the front case 25 vibrates during use of the working machine 10, vibration of the gripping portions 68 about the connecting portion 69 as a fulcrum can be prevented because the projection 59 is fit in the hole 73. Therefore, the worker can concentrate on the work without worrying about the presence of the cap 67. In addition, it is possible to prevent the gripping portions 68 from being separated from the connecting portion 69 due to the vibration.

Also, the base portion 71 is sandwiched between the front case 25 and the housing 14, and the cap 67 is fixed to the front case 25. Therefore, in a state where the plugs 70 are pulled out of the attaching hole 41, the cap 67 does not drop off the front case 25 and is not lost.

Note that the housing 14 may be divided into two parts including a first configuration piece and a second configuration piece along the straight line A3. Then, the configuration in which the locking grooves 72 are respectively provided in the first configuration piece and the second configuration piece and the base portion 71 is sandwiched by the first configuration piece and the second configuration piece may also adopted. Also in the configuration in which the housing 14 is divided into two parts as described above, it is possible to prevent the cap 67 from being lost.

Further, in a state where the plug 70 is inserted in the attaching hole 41 as shown in FIG. 10(A), the cap 67 is disposed between an upper end of the fixing portion 40 and the axis A1 in the direction of the straight line A3. Namely, the cap 67 does not protrude from the upper end of the fixing portion 40. Therefore, it is possible to suppress the cap 67 from coming in contact with, catching on, or rubbing on surrounding objects in a workplace, and the cap 67 can be prevented from turning over and dropping off.

Although the two gripping portions 68 are provided and the plugs 70 are respectively provided to the gripping portions 68, only one gripping portion 68 and plug 70 are shown in FIG. 10 for convenience. Further, the structure to fix the cap 67 includes a structure to fix the cap 67 with an adhesive or by crimping in addition to the structure to sandwich the cap 67 between the front case 25 and the housing 14.

Figure 11:
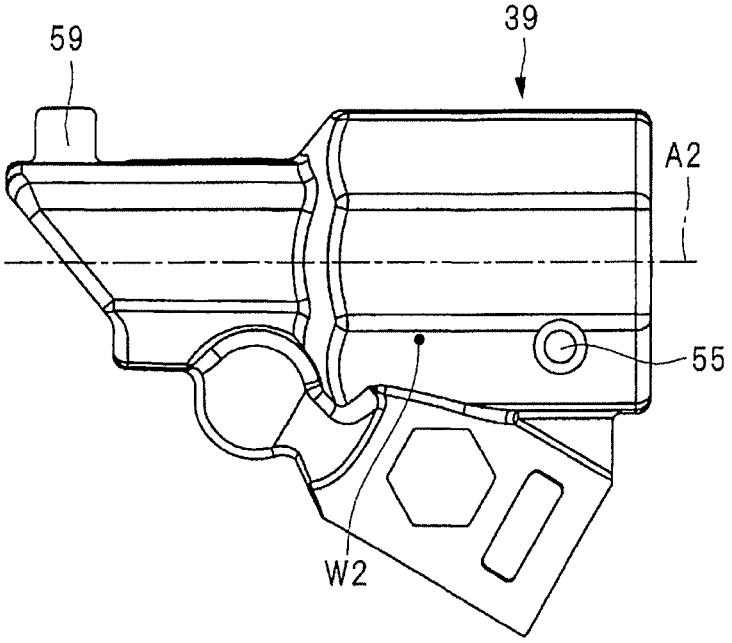
FIG. 11(A) is a side view of a mount member attached to the working machine of FIG. 1.
FIG. 11(B) is a side sectional view of the mount member.
Figure 11:
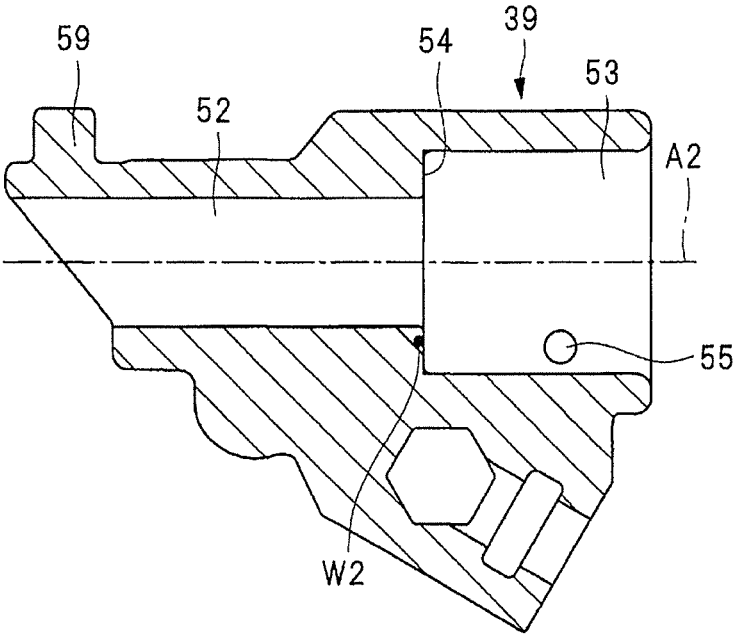

Next, the center of gravity of the working machine 10 will be described. In the side view of the working machine 10 in FIG. 3, a center of gravity W1 is in a disposition region of the trigger switch 77. In short, the center of gravity W1 is located between the housing 14 and the mounting portion 16 in the direction of the straight line A3. The center of gravity W1 is a center of gravity in a state where the battery pack 17 is attached to the mounting portion 16. Further, the position of the center of gravity of the mount member 39 alone is shown in FIG. 11. A center of gravity W2 of the mount member 39 alone is located between the axis A1 and the center line A2 of the first support hole 52 and the second support hole 53. In other words, the center line A2 is located between the projection 59 and the center of gravity W2, and the center of gravity W2 is located below the center line A2.

Therefore, when the holding tool 36 to which the mount member 39 is attached is attached to the front case 25, the projection 59 is located above the center line A2. In other words, by simply inserting the joint 37 into the first support hole 52 and the second support hole 53 and attaching the joint 37 to the mount member 39, the attaching state of the mount member 39 with respect to the joint 37 becomes a state where the projection 59 is automatically located above the center line A2 by its own weight, as shown in FIG. 10(B). Therefore, the work to fix the holding tool 36 to the front case 25 can be easily performed.

Figure 12:
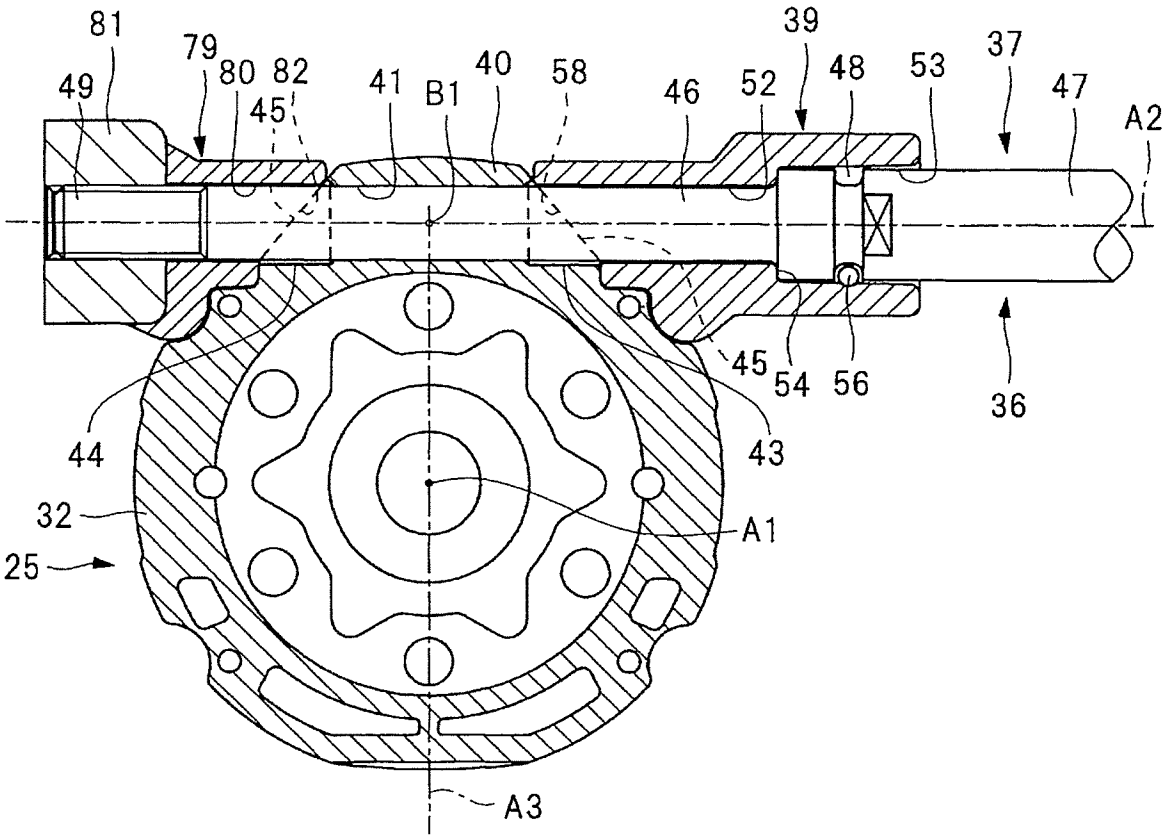
FIG. 12 is a front sectional view showing an example of attaching the holding tool to the front case.

FIG. 12 shows an example of fixing the holding tool 36 to the front case 25. No internal thread 42 is provided in the inner surface of the attaching hole 41. In a state where the first shaft portion 46 of the joint 37 is inserted in the attaching hole 41, the external thread 49 provided in the first shaft portion 46 is disposed outside the attaching hole 41. A mount member 79 is provided in addition to the mount member 39. The mount member 79 has a support hole 80, and the first shaft portion 46 is disposed in the support hole 80. The mount member 79 is integrally formed of a synthetic resin. Also, a part of the first shaft portion 46 having the external thread 49 formed therein is disposed outside the support hole 80.

A nut 81 is attached to the external thread 49, and the holding tool 36 is fixed to the front case 25 by tightening the nut 81. The fixing portion 40 is sandwiched between the mount member 39 and the mount member 79 in the direction of the center line A2. Namely, the second shaft portion 47 and the nut 81 apply a compressive load in the direction of the center line A2 to the mount members 39 and 79 and the fixing portion 40. The mount member 79 has a contact surface 82, and the contact surface 82 and the contact surface 45 are in contact with each other. Namely, in a state where the nut 81 is tightened, the contact surface 82 is pressed against the contact surface 45. The contact surface 82 is inclined similarly to the contact surface 58.

Figure 13:
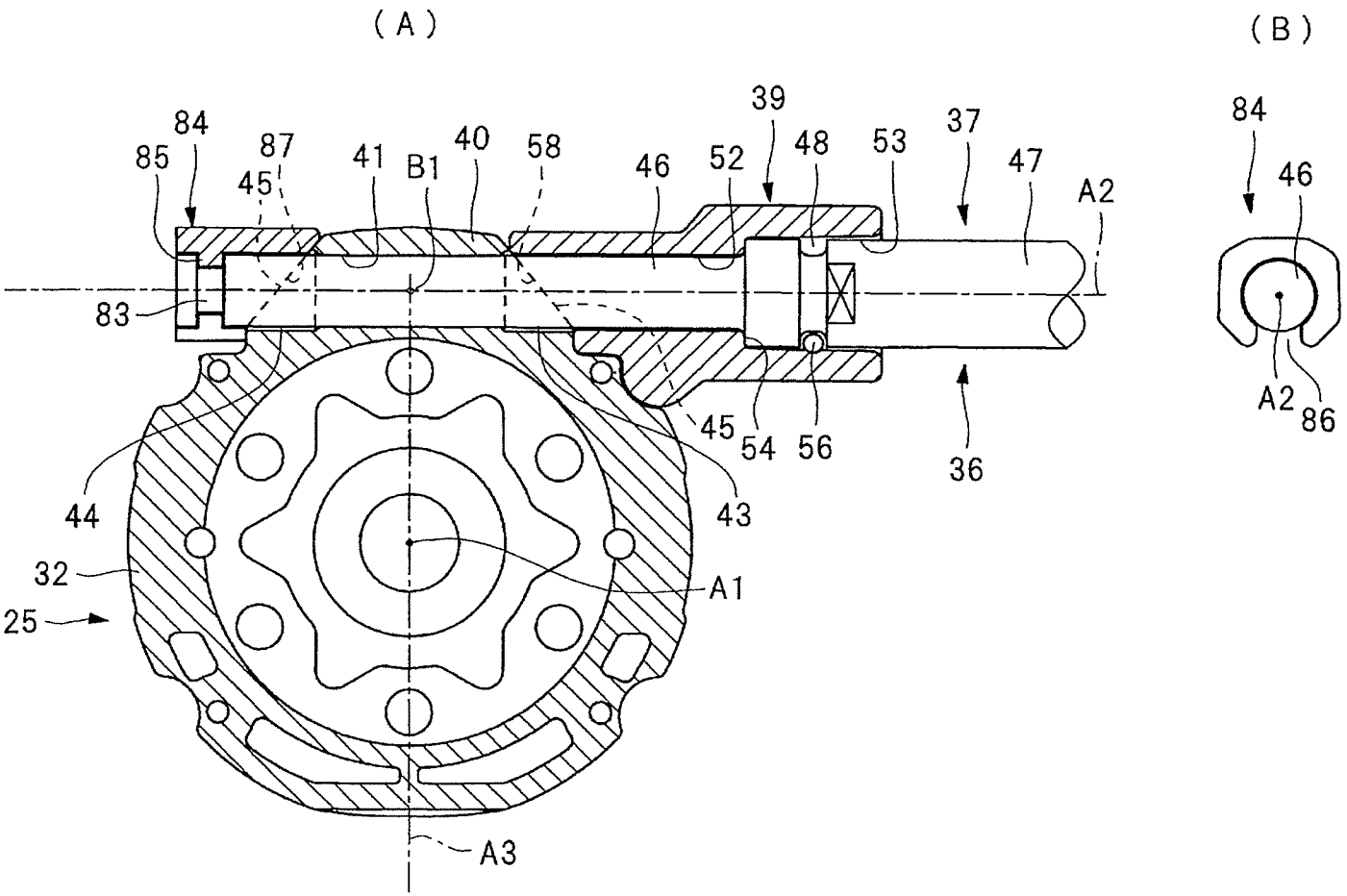
FIG. 13(A) is a front sectional view showing an example of attaching the holding tool to the front case.
FIG. 13(B) is a side view of the mount member shown in FIG. 13(A)

FIG. 13 shows an example of attaching the holding tool 36 to the front case 25. In the joint 37 shown in FIG. 13, no external thread 49 is provided in the first shaft portion 46. An annular groove 83 is provided in the outer peripheral surface of the first shaft portion 46, and the part of the first shaft portion 46 having the groove 83 formed therein is located outside the attaching hole 41 in a state where the first shaft portion 46 is inserted in the attaching hole 41.

Further, a mount member 84 to be attached to the first shaft portion 46 is provided. The mount member 84 has a C shape in a plan view intersecting with the center line A2. Namely, the mount member 84 has a cutout 86. Further, a projection 85 is provided on an inner peripheral surface of the mount member 84. The projection 85 protrudes inward in the radial direction from the inner peripheral surface of the mount member 84. The mount member 84 is disposed outside the attaching hole 41. The mount member 84 has a contact surface 87. The contact surface 87 is configured similarly to the contact surface 58.

The mount member 84 is integrally formed of a synthetic resin, and when the mount member 84 is pressed against the first shaft portion 46, the cutout 86 expands and the mount member 84 is attached to the first shaft portion 46. When the mount member 84 is attached to the first shaft portion 46, the projection 85 is located in the groove 83. Namely, the joint 37 and the mount member 84 are positioned and fixed in the direction of the center line A2 by an engagement force between the projection 85 and the first shaft portion 46. Further, in a state where the mount member 84 is attached to the first shaft portion 46, the contact surface 87 of the mount member 84 is pressed against the contact surface 45. Namely, the fixing portion 40 is sandwiched between the mount member 39 and the mount member 84, and the holding tool 36 is fixed to the front case 25.

In addition, the size of the cutout 86 is less than the outer diameter of the first shaft portion 46. Therefore, the mount member 84 will not come off the first shaft portion 46 unless the mount member 84 is elastically deformed. Further, by moving the mount member 84 in the radial direction with respect to the first shaft portion 46 and elastically deforming the mount member 84, the mount member 84 can be attached to and detached from the first shaft portion 46. Namely, the mount member 84 can be attached to and detached from the first shaft portion 46 by one motion, and the work to attach and detach the holding tool 36 to and from the front case 25 is facilitated.

In the example of attaching the holding tool 36 shown in FIGS. 12 and 13, it is possible to block the attaching hole 41 with the cap 67 described with reference to FIGS. 8 to 11 in a state where the holding tool 36 is not attached to the front case 25. In addition, the attaching hole 41 penetrates the fixing portion 40 and the holding tool 36 is attached via the mount member 39 also in FIGS. 12 and 13, and thus the effects described with reference to FIGS. 1 to 7 can be obtained.

FIG. 14(A) shows an example in which the holding tool 36 is attached to the mounting portion 16. Note that the example of attaching the holding tool 36 to the mounting portion 16 is shown by the two-dot chain lines in FIG. 2. As shown in FIG. 14(B), a fixing portion 88 is provided in the mounting portion 16. A nut 89 is fixed to the fixing portion 88, and an internal thread 91 is provided in an inner surface of an attaching hole 90 of the nut 89. The fixing portion 88 has opening portions 92 and 93 disposed on both sides of the attaching hole 90. The holding tool 36 is attached to the fixing portion 88 via a mount member 94 shown in FIGS. 15(A) and 15(B). The mount member 94 is configured similarly to the mount member 39 shown in FIGS. 5 and 6. The mount member 94 shown in FIG. 15 does not have the contact surface 58.

Figure 14:
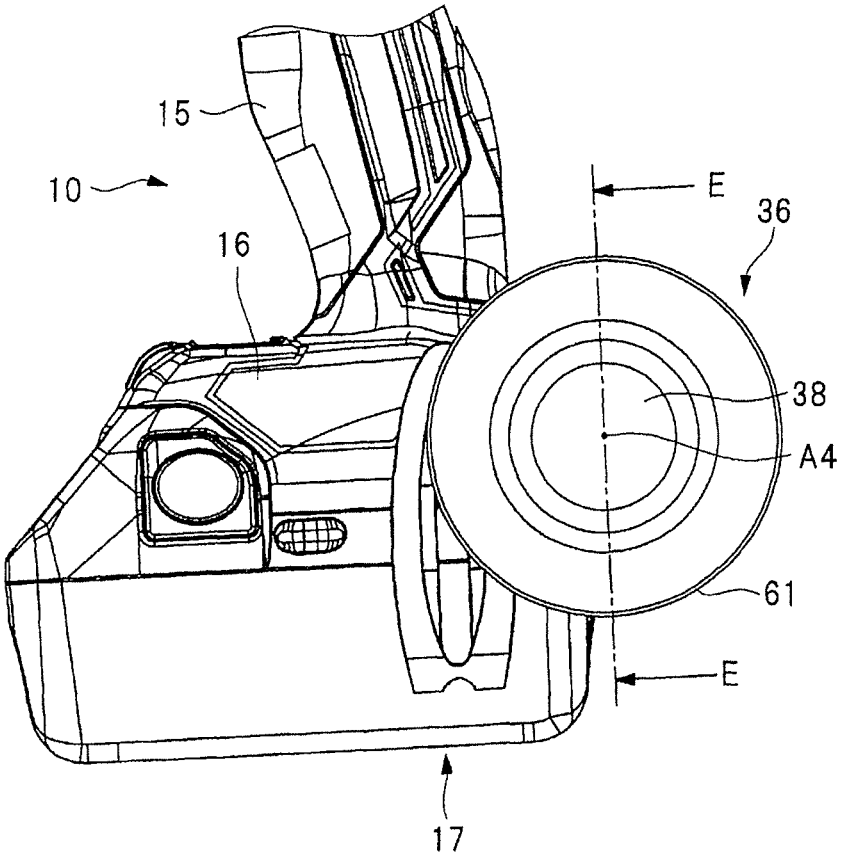
FIG. 14(A) is a side view showing an example of attaching the holding tool to a mounting portion.
FIG. 14(B) is a side view of the mounting portion to which the holding tool is attachable.
Figure 14:
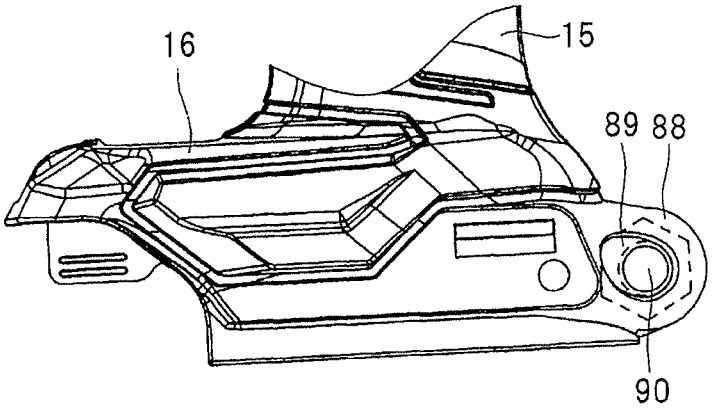

When the holding tool 36 in FIG. 14 is attached to the mounting portion 16, the nut 89 and the holding tool 36 are concentrically positioned as shown in FIG. 15(A), and the first shaft portion 46 is inserted into the attaching hole 90 through the opening portion 92, and the handle 38 is rotated. Then, the external thread 49 of the first shaft portion 46 is screwed into the internal thread 91 of the nut 89. Further, when the mount member 94 is pinched between the second shaft portion 47 and the fixing portion 88 as shown in FIG. 15(B), tightening of the joint 37 is completed and the holding tool 36 is fixed to the mounting portion 16.

When the holding tool 36 is fixed to the mounting portion 16, a center line A4 of the joint 37 is parallel to the center line A2. In FIG. 2, the center line A4 and the straight line A3 intersect at an intersection B2. Further, the distance L1 from the axis A1 to the flange 61 when the holding tool 36 is fixed to the mounting portion 16 is equal to the distance L1 from the axis A1 to the flange 61 when the holding tool 36 is fixed to the front case 25. In addition, the distance from the axis A1 to the intersection B2 is longer than the distance from the axis A1 to the intersection B1. Namely, when the main body 11 vibrates around the axis A1, the amount of vibration generated at the intersection B2 is larger than the amount of vibration generated at the intersection B1. Therefore, it is possible to effectively suppress the vibration of the main body 11 by attaching the holding tool 36 to the mounting portion 16. The vibration of the main body 11 can be grasped as rotation of the main body 11, and a vibration force of the main body 11 can be grasped as a rotation amount of the main body 11.

Further, a distance L2 from the straight line A3 to the tip end of the handle 38 when the holding tool 36 is attached to the mounting portion 16 is shorter than a distance L3 from the straight line A3 to the tip end of the handle 38 when the holding tool 36 is attached to the front case 25. Therefore, when the holding tool 36 is attached to the mounting portion 16, the handle 38 can be prevented from coming in contact with an object.

Figure 15:
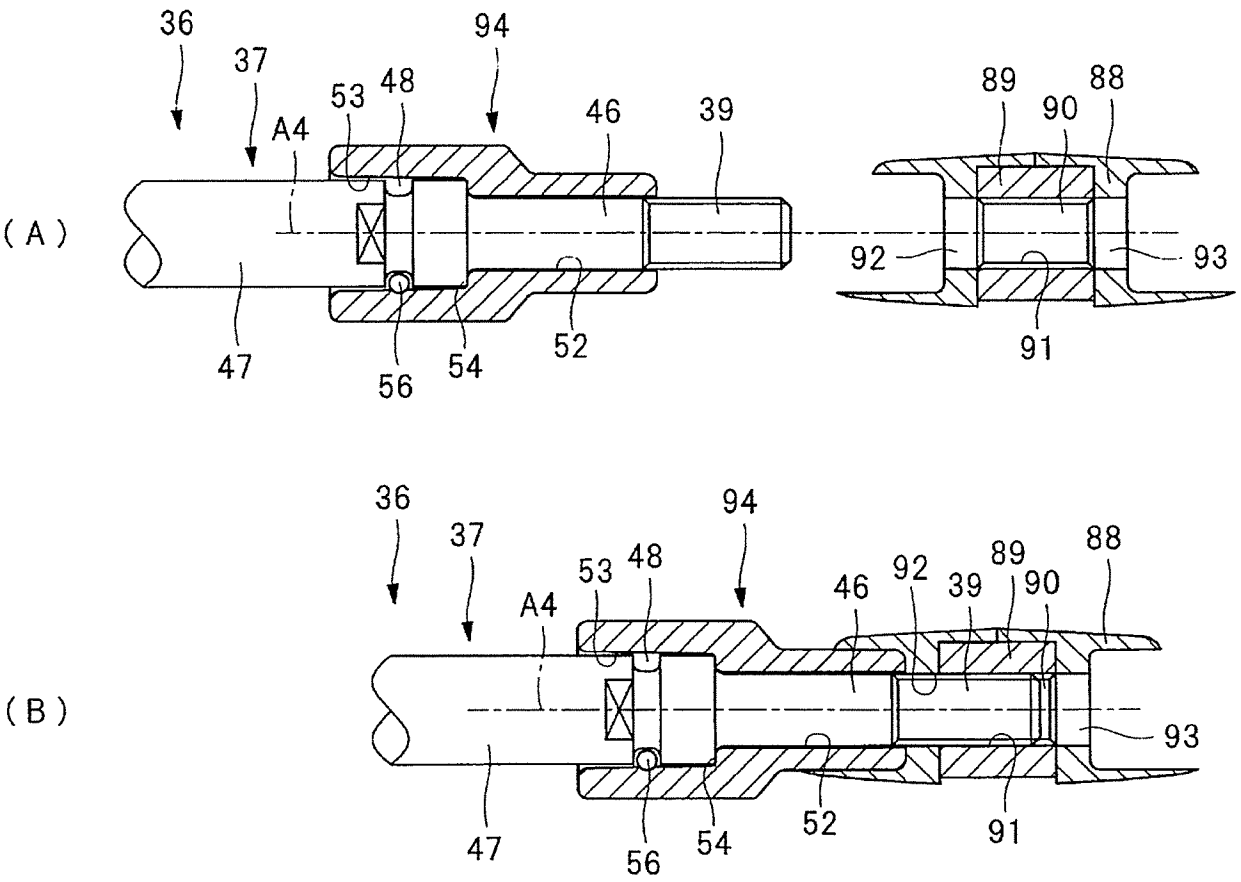
FIGS. 15(A) and 15(B) are sectional views taken along a line E-E in FIG. 14(A).

Note that FIG. 15 shows an example in which the holding tool 36 is fixed to the mounting portion 16 by inserting the first shaft portion 46 into the opening portion 92. Meanwhile, in the working machine 10 in FIG. 14, it is also possible to fix the holding tool 36 to the mounting portion 16 by inserting the first shaft portion 46 shown in FIG. 15 into the opening portion 93. Furthermore, in the working machine 10, the attaching hole 90 may be provided in the mounting portion 16, and the attaching hole 41 may be provided in the front case 25. The holding tool 36 is attached to either the front case 25 or the mounting portion 16. In other words, the holding tool 36 is not attached to both the mounting portion 16 and the front case 25. Note that the attaching hole 41 may be blocked with the cap 67 in a state where the holding tool 36 is not attached to the front case 25 shown in FIG. 12 or 13. Further, the attaching hole 90 may be blocked with a sealing member in a state where the holding tool 36 is not attached to the fixing portion 88 in FIG. 15.

Correspondence relation between the configuration described in each embodiment and the configuration of the present invention is as follows. The electric motor 12 corresponds to a motor of the present invention, the working machine 10 corresponds to a working machine of the present invention, the gearbox 27 corresponds to a transmission mechanism of the present invention, and the front case 25 corresponds to a case of the present invention. The holding tool 36 corresponds to a holding tool of the present invention, the attaching hole 41 corresponds to an attaching hole of the present invention, the recessed portions 43 and 44 and the opening portions 92 and 93 correspond to a first opening portion and a second opening portion of the present invention, the joint 37 corresponds to a shaft portion of the present invention, and the contact surface 45 corresponds to an attaching surface of the present invention.

Further, the tip end 37A of the joint 37 corresponds to "a tip end of the shaft portion" of the present invention, the intersection B1 corresponds to "a center in a center line direction" of the present invention, the contact surface 45 corresponds to a contact surface of the present invention, and the mount members 39 and 79 correspond to intermediate members of the present invention. The first support hole 52 and the second support hole 53 correspond to support holes of the present invention, the external thread 49 and the internal thread 42 correspond to a screw mechanism of the present invention, and the retainer 56 corresponds to a retainer of the present invention.

The grip 15 corresponds to a grip of the present invention, the direction of the straight line A3 corresponds to a "direction intersecting with an axis" of the present invention, and the battery pack 17 corresponds to a power supply mechanism of the present invention. The cap 67 corresponds to a sealing member of the present invention, the housing 14 corresponds to a housing of the present invention, the base portion 71 corresponds to a base portion of the present invention, the connecting portion 69 corresponds to a connecting portion of the present invention, the plug 70 corresponds to a plug of the present invention, the projection 59 corresponds to a supporting portion of the present invention, and the center of gravity W2 corresponds to "a center of gravity of the intermediate member" of the present invention.

The working machine of the present invention is not limited to the above embodiment, and various modifications can be made without departing from the gist of the invention. For example, the working machine of the present invention includes a driver that rotates a working tool to tighten or loosen a screw member or a bolt and a drill that cuts a mating member or bores a hole with a working tool. Further, the working machine described in the embodiment is a working machine having a first structure that imparts a rotational force to the working tool. The working machine of the present invention includes a working machine having a second structure and a working machine having a third structure. The working machine having the second structure can apply a rotational force and a striking force in the rotating direction to the working tool. The working machine having the third structure can apply a rotational force and a striking force in an axial direction to the working tool.

The transmission mechanism of the present invention is a mechanism that transmits the rotational force of the motor to the working tool, and the transmission mechanism includes a gear transmission mechanism, a winding transmission mechanism, and a friction transmission mechanism. The motor of the present invention includes an electric motor, a hydraulic motor, a pneumatic motor, and an engine. A power supply that supplies the electric power to the electric motor includes a DC power supply and an AC power supply. The power supply mechanism attached to and detached from the grip includes a battery pack as the DC power supply and an adapter connected to the AC power supply. The working machine of the present invention includes a structure in which a power cable attached to the grip is connected to the DC power supply or the AC power supply provided separately from the working machine. Namely, the power supply mechanism of the present invention includes a power supply itself and a path for supplying electric power of the power supply to the electric motor.

In the embodiment of the working machine, the connection structure between the joint and the handle includes a structure in which an external thread provided in the joint is screwed into an internal thread provided in the handle. Further, the working machine 10 described in the embodiment is an example in which the smaller angle formed between the straight line A3 and the center line A2 is 90 degrees as shown in FIG. 2. The working machine of the present invention includes a structure in which the smaller angle formed between the straight line A3 and the center line A2 is different from 90 degrees. For example, the working machine of the present invention includes a structure in which the straight line A3 and the center line A2 overlap in the front view of the working machine shown in FIG. 2. The working machine of this structure has a structure in which the power cable attached to the grip is connected to the AC power supply.

Furthermore, the working machine of the present invention includes a structure in which the angle formed between the straight line A3 and the center line A2 is 180 degrees in the front view of the working machine shown in FIG. 2. In the present invention, the plan view intersecting with the axis that is a rotation center of the working tool includes a plan view perpendicular to the axis and a plan view not perpendicular to the axis. Further, the working machine of the present invention includes a structure in which the holding tool is attached to the case without using the intermediate member. Also, a holding tool obtained by integrating the holding tool and the intermediate member described in the embodiment may be provided.

REFERENCE SIGNS LIST

25 Front case
36 Holding tool
41 Attaching hole
A1 Axis

The invention claimed is:

1. A working machine comprising:

a main body having a housing and a grip, the housing having a front side, a rear side, an upper side, and a lower side, and the grip extending downward from the lower side of the housing;

a metal case fixed to the front side of the housing with screw members, and exposed outside the housing, rigidity of the metal case being higher than rigidity of the housing;

a motor provided in the housing;

a transmission mechanism transmitting a rotational force of the motor to a working tool;

a threaded attaching hole provided in the metal case and penetrating through the metal case in plane view intersecting with an axis of the motor; and a holding tool that is attached to the metal case so as to protrude from an outer surface of the metal case and is gripped by a worker, wherein the threaded attaching hole penetrates through the metal case in plan view, and intersects with an axis that is a rotation center of the working tool, wherein the holding tool includes:

a handle gripped by the worker; and a shaft extending from the handle in an axial direction of the handle, and having a threaded first part engaged with the threaded attaching hole of the metal case.

2. The working machine according to claim 1, wherein the handle and the shaft are concentrically arranged and the handle and the shaft are connected to each other.

3. The working machine according to claim 1, further comprising a sealing member configured to block the threaded attaching hole when the shaft of the holding tool is not present in the threaded attaching hole.

4. The working machine according to claim 3, further comprising a housing that houses the motor, wherein the metal case is fixed to the housing, and a part of the sealing member is sandwiched between the housing and the metal case.

5. The working machine according to claim 4, wherein the sealing member includes:

a deformable connecting part continuous with the part of the sealing member; and a plug which is continuous with the deformable connecting part and is fit into the threaded attaching hole, and the intermediate member includes a supporting part that supports the plug.

6. The working machine according to claim 1, wherein a first opening part and a second opening part are formed on both sides of the threaded attaching hole in a center line direction, and wherein a tip end of the shaft is located between a center in the center line direction and the second opening part when the holding tool is attached to the metal case.

7. The working machine according to claim 1, wherein the transmission mechanism is stored in the housing and the metal case, wherein an intermediate member has a support hole, wherein the shaft has a second part, wherein when the holding tool is attached to the metal case, (1) the intermediate member is disposed between the metal case and the handle to connect the support hole and the threaded attaching hole together, (2) the shaft extends from the handle through the support hole into the threaded attaching hole, (3) the threaded first part of the shaft engages the threaded attaching hole, and (4) the second part of the shaft is located in the support hole of the intermediate member, and wherein the threaded attaching hole in the metal case extends laterally with respect to a direction from the front side to the rear side of the housing, and is provided at a position in front of the housing and higher than the transmission mechanism.

8. The working machine according to claim 7, wherein the metal case has a first attaching surface that is outside the threaded attaching hole, the intermediate member has a second attaching surface, and the first attaching surface is in surface contact with the second attaching surface when the holding tool is attached to the metal case.

9. The working machine according to claim 8, wherein the first and second attaching surfaces are inclined with respect to a center axis of the threaded attaching hole.

10. The working machine according to claim 8, wherein the support hole of the intermediate member includes (1) a first part having a first inner diameter, (2) a second part having a second inner diameter that is greater than the first inner diameter, and (3) a first wall that closes a first gap between the first part and the second part, the first gap being present due to a difference between the first inner diameter and the second inner diameter, wherein the second part of the shaft has (1) a third part having a first outer diameter that allows the third part to be inserted into the first part of the support hole, (2) a fourth part having a second outer diameter that is greater than the first outer diameter, and (3) a second wall that closes a second gap between the third part and the fourth part, the second gap being present due to a difference between the first outer diameter and the second outer diameter, wherein the second wall of the shaft is in contact with the first wall of the support hole when the shaft is inserted into the support hole, and wherein a shape of the first wall is different from a shape of the second wall.

11. The working machine according to claim 7, wherein the support hole of the intermediate member includes (1) a first part having a first inner diameter, (2) a second part having a second inner diameter that is greater than the first inner diameter, and (3) a first wall that closes a first gap between the first part and the second part, the first gap being present due to a difference between the first inner diameter and the second inner diameter, the second part of the shaft has (1) a third part having a first outer diameter that allows the third part to be inserted into the first part of the support hole, (2) a fourth part having a second outer diameter that is greater than the first outer diameter, and (3) a second wall that closes a second gap between the third part and the fourth part, the second gap being present due to a difference between the first outer diameter and the second outer diameter, and the second wall of the shaft is in contact with the first wall of the support hole when the shaft is inserted into the support hole.

12. The working machine according to claim 11, wherein the intermediate member has a hole penetrating from an inner surface of the second part of the support hole to an outer surface of the intermediate member, the shaft has a groove on an outer surface of the fourth part, and the working machine further includes a retainer to be inserted into the hole of the intermediate member to engage the groove of the shaft.

13. The working machine according to claim 7, wherein the intermediate member extends beyond an outer surface of the metal case when the holding tool is attached to the metal case.

14. The working machine according to claim 7, wherein a center of gravity of the intermediate member is disposed between the axis and a center line of the holding tool in plan view intersecting with the axis when the holding tool is attached to the metal case.

15. A working machine comprising:

a main body having a housing and a grip, the housing having a front side, a rear side, an upper side, and a lower side, and the grip extending downward from the lower side of the housing;

a metal front case fixed to the front side of the housing with screw members, and exposed outside the housing, rigidity of the metal front case being higher than rigidity of the housing;

a motor provided in the housing; and a transmission mechanism transmitting a rotational force of the motor to a working tool, a threaded attaching hole provided in the metal front case and penetrating through the metal front case, the threaded attaching hole extending laterally with respect to a direction from the front side to the rear side of the housing, and being configured to connect a threaded shaft of a holding tool to the metal front case, the holding tool extending laterally from the metal front case.

16. The working machine according to claim 15, wherein the metal front case comprises a fixing portion integrally protruding upward from a top of the metal front case, the threaded attaching hole being provided at the fixing portion.

17. The working machine according to claim 16, wherein the metal front case has a fixing portion that is a protruded part of the metal front case and has the threaded attaching hole.

18. The working machine according to claim 16, wherein the threaded attaching hole laterally penetrates through the metal front case, such that the holding tool can be connected to the attaching hole from both a first lateral side of the fixing portion and a second lateral side of the fixing portion which is opposite of the first lateral side.

19. The working machine according to claim 18, wherein, when the holding tool is connected to the metal front case from the first lateral side of the fixing portion, a tip end of the holding tool is located nearer to the second lateral side than the first lateral side.

20. The working machine according to claim 18, wherein the first lateral side of the fixing portion has a first inclined surface and the second lateral side of the fixing portion has a second inclined surface, such that a width of the fixing portion in lateral direction is smaller at a top of the fixing portion than at a bottom of the fixing portion.

21. The working machine according to claim 20, wherein a mount member is disposed between the fixing portion and the holding tool, the mount member having a third inclined surface configured to parallel contact with the first inclined surface when the holding tool is connected to the fixing portion from the first lateral side of the fixing portion.

22. The working machine according to claim 15, wherein the threaded attaching hole is disposed on an outer side of the metal front case relative to the transmission mechanism in a radial direction about an axis of the motor.

23. The working machine according to claim 15, wherein the transmission mechanism is stored in the housing and the metal front case, and wherein the threaded attaching hole is provided at a position in front of the housing and higher than the transmission mechanism.

* * * * *